US006971735B2

(12) United States Patent
Saito et al.

(10) Patent No.: US 6,971,735 B2
(45) Date of Patent: Dec. 6, 2005

(54) INK-JET PRINTHEAD BOARD, INK-JET PRINTHEAD, AND INK-JET PRINTING APPARATUS

(75) Inventors: Ichiro Saito, Kanagawa (JP); Tatsuo Furukawa, Kanagawa (JP); Yoshiyuki Imanaka, Kanagawa (JP); Nobuyuki Hirayama, Kanagawa (JP); Muga Mochizuki, Kanagawa (JP); Takaaki Yamaguchi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/170,724

(22) Filed: Jun. 14, 2002

(65) Prior Publication Data

US 2002/0191044 A1 Dec. 19, 2002

(30) Foreign Application Priority Data

Jun. 15, 2001 (JP) ..... 2001-182465

(51) Int. Cl.[7] ..... B41J 2/05
(52) U.S. Cl. ..... 347/57
(58) Field of Search ..... 347/9, 56–59, 347/20, 61

(56) References Cited

U.S. PATENT DOCUMENTS

| | | | | |
|---|---|---|---|---|
| 4,459,600 A | | 7/1984 | Sato et al. | 346/140 R |
| 4,558,333 A | | 12/1985 | Sugitani et al. | 346/140 R |
| 4,723,129 A | | 2/1988 | Endo et al. | 346/1.1 |
| 4,740,796 A | | 4/1988 | Endo et al. | 346/1.1 |
| 4,743,957 A | * | 5/1988 | Hirayama | 326/69 |
| 4,970,533 A | * | 11/1990 | Saito et al. | 347/86 |
| 5,371,395 A | * | 12/1994 | Hawkins | 257/357 |
| 5,696,544 A | * | 12/1997 | Komuro | 347/50 |
| 5,850,242 A | * | 12/1998 | Asaba | 347/59 |
| 6,257,695 B1 | | 7/2001 | Kamiyama et al. | 347/19 |
| 6,390,589 B1 | | 5/2002 | Imanaka et al. | 347/19 |

FOREIGN PATENT DOCUMENTS

| | | |
|---|---|---|
| EP | 0 499 373 A2 | 8/1992 |
| EP | 0 694 391 A2 | 1/1996 |
| EP | 0 816 082 A2 | 1/1998 |
| JP | 54-56847 | 5/1979 |
| JP | 59-123670 | 7/1984 |
| JP | 59-138461 | 8/1984 |
| JP | 60-71260 | 4/1985 |

OTHER PUBLICATIONS

Device Electronics for Integrated Circuits, 2nd Ed., Richard S. Muller, pp. 443-444.*

* cited by examiner

*Primary Examiner*—Juanita D. Stephens
(74) *Attorney, Agent, or Firm*—Fitzpatrick, Cella, Harper & Scinto

(57) ABSTRACT

A stable operation is realized without any malfunction of a driver even under a voltage condition that a supplied voltage is 3.3 V or lower. For this purpose, in an ink-jet printhead having an ink orifice for discharging ink, a plurality of heat generation elements for generating heat energy used to discharge ink, and an ink channel which incorporates the heat generation elements and communicates with the ink orifice, a driver for driving the heat generation elements, and a logic circuit for controlling the driver are formed on a single board. The gate oxide film thickness of an enhancement NMOS transistor which forms the driver is larger than that of an enhancement NMOS transistor which forms the logic circuit.

32 Claims, 21 Drawing Sheets

CMOS LOGIC

NMOS LOGIC

NMOS LOGIC

DRIVER CIRCUIT EXAMPLE

STRUCTURE OF ENHANCEMENT NMOSTr

INK-JET PRINTHEAD BOARD, INK-JET PRINTHEAD, AND INK-JET PRINTING APPARATUS

FIELD OF THE INVENTION

The present invention relates to a printhead board, a printhead using the board, and a printing apparatus on which the printhead is mounted.

BACKGROUND OF THE INVENTION

Ink-jet printing is a printing method with a more prominent feature than other printing methods because of little printing noise and high-speed printing.

In the printhead of a conventional printing apparatus which adopts this printing method, orifices formed to discharge a liquid such as ink, and electrothermal transducers (heaters) which communicate with the orifices and generate, as energy generation elements for discharging ink, predetermined heat energy in order to heat and discharge droplets of ink or the like are arranged on a printhead element board (to be also referred to as a heater board "HB").

Further, a plurality of drivers for driving the respective heaters, a memory which temporarily stores printing data input from a printing apparatus in order to transfer serial printing data as parallel data to the respective drivers, and a logic circuit such as a latch circuit which holds data output from the memory in order to output the data at a predetermined timing are conventionally mounted on the same board (HB) in addition to a plurality of heaters.

The printhead board requires (1) a power supply for driving the heaters and (2) two power supplies for driving the memory, logic circuit, and the like. The power supply for the logic circuit generally uses a power supply voltage of 5 V. This power supply is unified to an IC power supply for a CPU, memory, and the like on the printing apparatus main body. This can eliminate the needs for preparing a dedicated logic power supply, and can achieve space reduction of the circuit layout, downsizing, and cost reduction.

In general, a parallel interface is employed as an interface for connecting an ink-jet printer and, e.g., a personal computer which controls the printer. In this case, the logic power supply voltage (VL) of the printer main body is 5 V, and the ink-jet printhead board in the head also uses 5 V for the logic power supply. The above-described prior art, therefore, sets VL to 5 V. The logic voltage VL of 5 V has been used because some ICs require a power supply of 5 V in the ICs of the internal printer circuit.

In recent years, it becomes disadvantageous to prepare 5 V for the logic power supply of the printer main body in terms of the cost and size along with improvements in IC technique and the use of a new interface. The recent mainstream of the logic power supply voltage VL of the printer main body is shifting to 3.3 V.

However, it is difficult to simply optimize the logic power supply voltage to 3.3 V because the head board mixedly bears a logic circuit and a high-breakdown-voltage driver for driving a heater.

Several problems posed upon decreasing the logic power supply voltage of a conventional head board from 5 V to 3.3 V will be explained.

(1) Problem on Operation Speed

A decrease in the image data transfer ability (operation speed) of an ink-jet printhead board will be described as one of the problems.

FIG. 15 shows an arrangement in the ink-jet printhead board. In FIG. 15, reference numeral 1003 denotes each pad for receiving an external signal. The pads 1003 have a VDD terminal 1006 for receiving a logic power supply voltage, a VH terminal 1008 for receiving a heater driving power supply voltage, a GNDH terminal 1005 connected to ground, a CSS terminal 1007, and the like. Logic circuits 1002 such as a shift register for receiving serial image data and outputting parallel data, drivers 1001 for driving heaters, heaters 1004, and the like are arranged on a single silicon board.

FIG. 16 shows in detail a case in which 640-bit heaters are formed. In this case, 40 bits out of the 640-bit heaters are simultaneously driven at maximum. This operation is repeated 16 times to drive all the 640-bit heaters (one cycle). FIG. 17 shows the timings. A speed required to send image data when all the 640 bits are driven at a driving frequency of 15 kHz (used in existing products) necessary for predetermined high-speed printing will be explained.

The frequency of 15 kHz has a cycle of 66.67 $\mu$S. Image data of 40 bits must be transferred by 16 time divisions (blocks) within this period. The image data transfer rate is calculated as at least 12 MHz or higher. This rate is not so high for a general CPU or the like. For an ink-jet printhead, however, 12 MHz is not low because a carriage to be driven and a main body are connected by a long flexible board or the like and the carriage must be downsized for a compact printer.

A decrease in transfer ability when the logic power supply voltage is decreased from 5 V to 3.3 V in this situation will be explained with reference to FIGS. 18A and 18B. FIG. 18A is a graph showing the relationship between the voltage of a logic signal (power supply) and the maximum CLK frequency capable of transferring image data.

As shown in FIG. 18A, the CLK frequency tends to decrease as the voltage of the logic signal (power supply) decreases. This is because the drivability of, e.g., a CLK input circuit portion for transferring image data and that of a MOS transistor used in a shift register unit degrade at the same time as a decrease in logic power supply voltage directly used as the gate voltage of a CMOS. As shown in FIG. 18A, the drivability (drain current Id) decreases with a decrease in gate voltage.

The ink-jet printhead board must attain a satisfactory temperature rise by driving heaters on the board. This is a characteristic ability demanded of the ink-jet printhead board for discharging ink by heaters. FIG. 18B is a graph showing the relationship between the board temperature and the maximum CLK frequency. As shown in FIG. 18B, the ability is poor at a logic power supply voltage of 3.3 V, and as the temperature rises, tends to further degrade.

As described above, appropriate circuit operation has been attained at a CLK frequency of 12 MHz for 5 V. As the logic power supply voltage decreases to, e.g., 3.3 V, the operation speed must be increased.

(2) Noise Problem

A voltage drop by the impedance of a power line or a malfunction by the voltage drop generated by the impedance of the power line or a noise component such as overshooting may occur under the influence of increases in speed and the number of bits in a recent printhead and a printing apparatus (printer) using the printhead.

For example, for a typical A4-printer, the length of a power cable for a flexible board or the like which extends from the power supply of a main body to a head is about 40 cm. The resistance (R) component of the cable is about 20 mΩ to 100 mΩ though it changes depending on the cable material and the number of parallel-connected lines. The inductance (L) component is about 0.1 μH to 0.5 μH. The parasitic impedance of the power line is a contact resistance at the contact with the head or the capacitance (C) component of the head. The contact resistance is about 30 mΩ to 200 mΩ though it changes depending on the contact material and the number of pads used as power supply terminals. The capacitance is about 10 pF to 100 pF.

A current flowing through the power line is about 150 mA per segment, and is 0.9 A when the maximum number of simultaneously driven segments per color is 16. In a recent 6-color printer, a total instantaneous current is as large as 5.4 A.

If the 5.4-A current flows through the above-mentioned power line having impedance components R, L, and C, overshooting causes ringing, which fluctuates the voltage of the power line. The voltage fluctuation is about 0.5 V to 1.0 V in actual measurement and electric circuit simulation.

In particular, the voltage fluctuation generated in the GND line of a driver transistor can cause a current driving malfunction. A means for preventing any malfunction even upon voltage fluctuations must be adopted.

(3) Problem on Common Voltage in Logic Unit

In a recent printhead and a printing apparatus (printer) using the printhead, the logic signal voltage tends to be decreased for a higher-speed heater driving circuit and external signal processing circuit such as a CPU and a finer design rule. The logic signal voltage is abruptly shifting to the current voltage of 5 V to 3.3 V.

The voltage of the CPU is decreased as the manufacturing process becomes finer. For example, the power supply voltage is predicted to be about 2.0 V in the use of a 0.5-μm rule process, and 1.5 V or lower in the use of a 0.15 to 0.18-μm rule process. It is important for cost reduction of the overall apparatus in terms of voltage sharing to set the signal voltage of the external processing circuit and the internal logic signal voltage of the head to be equal to each other. The internal logic signal voltage of the head will be decreased to 3.3 V→2.0 V→1.5 V→ lower voltage. The possibility of causing malfunctions along with the decrease in voltage increases in a circuit block for driving a driver transistor in accordance with the logic circuit. A means which copes with a low voltage and a means for removing any adverse effect must be taken.

The power supply voltage of the IC on the printing apparatus main body is being decreased from 5 V to 3.3 or 2 V or lower. In this situation, problems (a) and (b) occur when the printing apparatus is to cope with the decrease in voltage without changing the circuit arrangement on the board (HB).

(a) When a power supply for the dedicated power supply voltage (5 V) of a logic circuit is newly prepared on the printing apparatus main body and the printing apparatus receives the voltage supply in order to drive the logic circuit of the board (HB), the number of power systems in the apparatus further increases. The printing apparatus main body becomes bulky, which is disadvantageous to downsizing of the apparatus and increases the cost. As a result, products become difficult to set on the current trend toward lower cost.

(b) When the apparatus main body supplies a power supply voltage of 3.3 V without changing the circuit arrangement on the board (HB), and the design specification of the logic circuit IC is set to a high power supply value such as 5 V, a simple decrease in voltage to 3.3 V leads to a decrease in the driving voltage of the logic circuit. The ON-OFF drivability (i.e., speed) for driving the logic circuit degrades. FIG. 8 is a graph qualitatively showing the relationship between the driving voltage and the data transfer rate. If the voltage decreases from 5 V to 3.3 V, the data transfer rate also decreases.

At present, the clock of the logic circuit and the like must be transferred at a higher rate for high-speed printing. In this situation, the logic driving performance becomes poor, degrading the specification of the printing performance. It, therefore, becomes difficult to maintain the image data transfer rate and meet needs for a higher transfer rate.

As a measure against problem (b) that balances the decrease in driving voltage and maintenance of the driving performance of the logic circuit, the circuit arrangement on the board (HB) may be changed, and the threshold of a transistor which constitutes the logic circuit may be decreased. In this case, problem (c) occurs.

FIGS. 5A, 5B, and 5C show an example of a power transistor formed on a board (HB). At present, the ink-jet printhead board (HB) mainly adopts an NMOS transistor as a heater driver in terms of the cost and drivability.

On the board (HB), a logic circuit for controlling the driver is constituted by an enhancement NMOS transistor having the same threshold as that of the NMOS transistor of the driver, and a PMOS transistor (or depletion NMOS transistor or resistor formed by pure diffusion or the like when the logic circuit is formed from only NMOS transistors) for forming a logic CMOS circuit. FIGS. 6A and 6B are graphs showing the transfer characteristics of NMOS transistors. FIGS. 7A and 7B are views, respectively, showing an enhancement NMOS transistor connected to a heater and the structure of the transistor.

(c) Since the operation threshold of the enhancement NMOS transistor is decreased, the drivability of the logic circuit can be maintained even in supplying a lower voltage than a conventional one. However, if common semiconductor manufacturing processes are used for cost reduction, the threshold of the transistor of the heater driver simultaneously decreases because of the same gate oxide film thickness. This may pose the following problem unique to the ink-jet printing apparatus.

FIG. 9A is a block diagram for schematically explaining the connection between the printing apparatus main body and the printhead. FIG. 9B shows an LCR circuit for equivalently expressing a circuit for outputting image data (DATA) and a clock (CLK). As shown in FIG. 9A, the printing apparatus main body serially outputs image data (DATA) in synchronism with clocks ($CLK_s$), and the data are received by a shift register 901. The received image data (DATA) are temporarily stored in a latch circuit 902, and an ON/OFF output corresponding to each image data value ("0" or "1") is output from the latch circuit. A heater driver 903 corresponding to a heater selected based on an ON output is driven only by the period of the input ON output. Then, a current flows through a corresponding heater 904 to execute printing operation.

To realize high-speed printing, many printing elements must be arranged. The printing elements are mounted on the carriage of the printhead, and receive head driving power together with a head control signal and the like via a flexible cable 905 which connects the printing apparatus main body and printhead.

The head driving voltage which flows through the flexible cable and drives heaters changes depending on the number of heaters driven in time division and the duty of a pattern for driving the heaters. The reactance (L) component of the equivalent circuit is superposed on the power wiring, and the heater driver readily malfunctions.

In this case, an abnormal current flows through the heater element, resulting in element destruction and a fatal fault.

When conventional design conditions based on a voltage of 5 V are applied to the use of 3.3 V or lower, the functions of the logic and driver circuits are very difficult to implement. To simultaneously satisfy the functions of the two circuits on the trend toward lower power consumption, the connection balance in the board must be simultaneously maintained.

SUMMARY OF THE INVENTION

To achieve the above object, according to the present invention, a printhead board, a printhead using the board, and a printing apparatus on which the printhead is mounted have the following arrangements.

That is, there is provided an ink-jet printhead board having a plurality of energy generation elements for generating energy used to discharge ink, a driver for driving the energy generation elements, and a logic circuit for controlling the driver, the logic circuit and the driver having enhancement NMOS transistors, wherein a voltage threshold of the enhancement NMOS transistor which forms the logic circuit is lower than a voltage threshold of the enhancement NMOS transistor which forms the driver.

There is also provided an ink-jet printhead board having a plurality of energy generation elements for generating energy used to discharge ink, a driver for driving the energy generation elements, and a logic circuit for controlling the driver, the logic circuit and the driver having enhancement NMOS transistors, wherein a gate oxide film thickness of the enhancement NMOS transistor which forms the driver is larger than a gate oxide film thickness of the enhancement NMOS transistor which forms the logic circuit.

There is also provided an ink-jet printhead board having a plurality of energy generation elements for generating energy used to discharge ink, a driver for driving the energy generation elements, and a logic circuit for controlling the driver, the logic circuit and the driver having enhancement NMOS transistors, wherein a concentration at a channel portion of the enhancement NMOS transistor which forms the driver is different from a concentration at a channel portion of the enhancement NMOS transistor which forms the logic circuit.

There is also provided an ink-jet printhead having an ink orifice for discharging ink, a plurality of energy generation elements for generating energy used to discharge ink, an ink channel which incorporates the energy generation elements and communicates with the ink orifice, a driver for driving the energy generation elements, and a logic circuit for controlling the driver, the logic circuit and the driver having enhancement NMOS transistors, and the generation elements, the driver, and the logic circuit being formed on a single board, wherein a voltage threshold of the enhancement NMOS transistor which forms the logic circuit is lower than a voltage threshold of the enhancement NMOS transistor which forms the driver.

There is also provided an ink-jet printhead having an ink orifice for discharging ink, a plurality of energy generation elements for generating energy used to discharge ink, an ink channel which incorporates the energy generation elements and communicates with the ink orifice, a driver for driving the energy generation elements, and a logic circuit for controlling the driver, the logic circuit and the driver having enhancement NMOS transistors, and the generation elements, the driver, and the logic circuit being formed on a single board, wherein a gate oxide film thickness of the enhancement NMOS transistor which forms the driver is larger than a gate oxide film thickness of the enhancement NMOS transistor which forms the logic circuit.

There is also provided an ink-jet printhead having an ink orifice for discharging ink, a plurality of energy generation elements for generating energy used to discharge ink, an ink channel which incorporates the energy generation elements and communicates with the ink orifice, a driver for driving the energy generation elements, and a logic circuit for controlling the driver, the logic circuit and the driver having enhancement NMOS transistors, and the generation elements, the driver, and the logic circuit being formed on a single board, wherein a concentration at a channel portion of the enhancement NMOS transistor which forms the driver is different from a concentration at a channel portion of the enhancement NMOS transistor which forms the logic circuit.

There is also provide an ink-jet printing apparatus having an ink-jet printhead having an ink orifice for discharging ink, a plurality of energy generation elements for generating energy used to discharge ink, an ink channel which incorporates the energy generation elements and communicates with the ink orifice, a driver for driving the energy generation elements, and a logic circuit for controlling the driver, the logic circuit and the driver having enhancement NMOS transistors, and the generation elements, the driver, and the logic circuit being formed on a single board, and convey means for conveying a printing medium which receives ink discharged from the ink-jet printhead, wherein a voltage threshold of the enhancement NMOS transistor which forms the logic circuit is lower than a voltage threshold of the enhancement NMOS transistor which forms the driver.

There is also provide an ink-jet printing apparatus having an ink-jet printhead having an ink orifice for discharging ink, a plurality of energy generation elements for generating energy used to discharge ink, an ink channel which incorporates the energy generation elements and communicates with the ink orifice, a driver for driving the energy generation elements, and a logic circuit for controlling the driver, the logic circuit and the driver having enhancement NMOS transistors, and the generation elements, the driver, and the logic circuit being formed on a single board, and convey means for conveying a printing medium which receives ink discharged from the ink-jet printhead, wherein a gate oxide film thickness of the enhancement NMOS transistor which forms the driver is larger than a gate oxide film thickness of the enhancement NMOS transistor which forms the logic circuit.

There is also provided an ink-jet printing apparatus having an ink-jet printhead having an ink orifice for discharging ink, a plurality of energy generation elements for generating energy used to discharge ink, an ink channel which incorporates the energy generation elements and communicates with the ink orifice, a driver for driving the energy generation elements, and a logic circuit for controlling the driver, the logic circuit and the driver having enhancement NMOS transistors, and the generation elements, the driver, and the logic circuit being formed on a single board, and convey means for conveying a printing medium which receives ink discharged from the ink-jet printhead, wherein a concentration at a channel portion of the enhancement NMOS transistor which forms the driver is different from a concentration at a channel portion of the enhancement NMOS transistor which forms the logic circuit.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

The following embodiments will exemplify a printer as a printing apparatus using an ink-jet printing method.

In this specification, "printing" means not only formation of significant information such as a character, figure, and the like, but also formation of an image, design, pattern, and the like on printing media and processing of media regardless of whether information is significant or insignificant or whether information is so visualized as to allow man to visually perceive it.

"Printing media" are not only paper used in a general printing apparatus, but also ink-receivable materials such as cloth, plastic film, metal plate, glass, ceramics, wood, and leather.

"Ink"(to be also referred to as "liquid") should be interpreted as widely as the definition of "printing". "Ink" represents a liquid which is applied to a printing medium to form an image, design, pattern, or the like, process the printing medium, or contribute to ink processing (e.g., solidification or insolubilization of a coloring material in ink applied to a printing medium).

<General Description of Apparatus Main Body>

Figure 10:
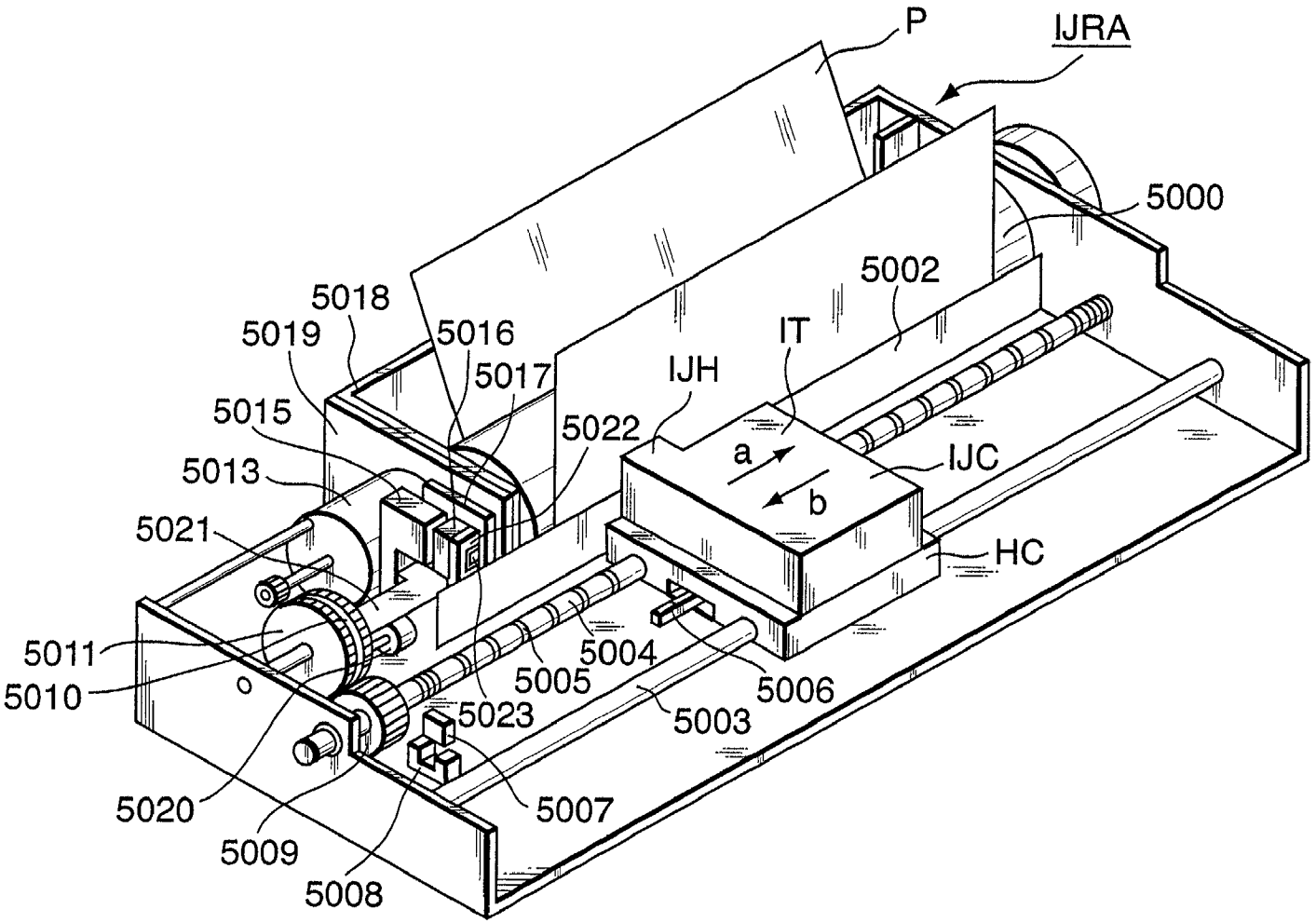
FIG. 10 is a perspective view showing the outer appearance of a printer according a preferred embodiment of the present invention.

FIG. 10 is a perspective view schematically showing the outer appearance of an ink-jet printer IJRA. In FIG. 10, a pin (not shown) is attached to a carriage HC which engages with a helical groove 5004 of a lead screw 5005 that rotates via driving force transfer gears 5009 to 5011 while interlocking with forward/reverse rotation of a driving motor 5013. The carriage HC is supported by a guide rail 5003 and reciprocates in directions indicated by arrows a and b. The carriage HC supports an integral-type ink-jet cartridge IJC which incorporates a printhead IJH and ink tank IT.

Reference numeral 5002 denotes a sheet press plate which presses a printing sheet P against a platen 5000 in the moving direction of the carriage HC; 5007 and 5008, photocouplers serving as home position detectors for detecting the presence of a carriage lever 5006 in a corresponding region and switching the rotational direction of the motor 5013.

Reference numeral 5016 denotes a member which supports a cap member 5022 which caps the front end of the printhead IJH; 5015, a suction unit which sucks the interior of the cap and performs suction recovery of the printhead via an intra-cap opening 5023; 5017, a cleaning blade; and 5019, a member capable of moving this blade back and forth. The cleaning blade 5017 and member 5019 are supported by a main body support plate 5018. The blade is not limited to this, and a known cleaning blade can be applied to the present invention.

Reference numeral 5021 denotes a lever which starts suction for suction recovery, and moves together with movement of a cam 5020 engaging with the carriage. A driving force from the driving motor is controlled by a known transfer mechanism such as a clutch switch.

Capping, cleaning, and suction recovery are executed by desired processes at corresponding positions by the operation of the lead screw 5005 when the carriage comes to the home-position region. Any processes can be applied to the present invention so far as desired operations are done at known timings.

<Description of Control Arrangement>

A control arrangement for executing printing control of the above-described apparatus will be described.

Figure 11:
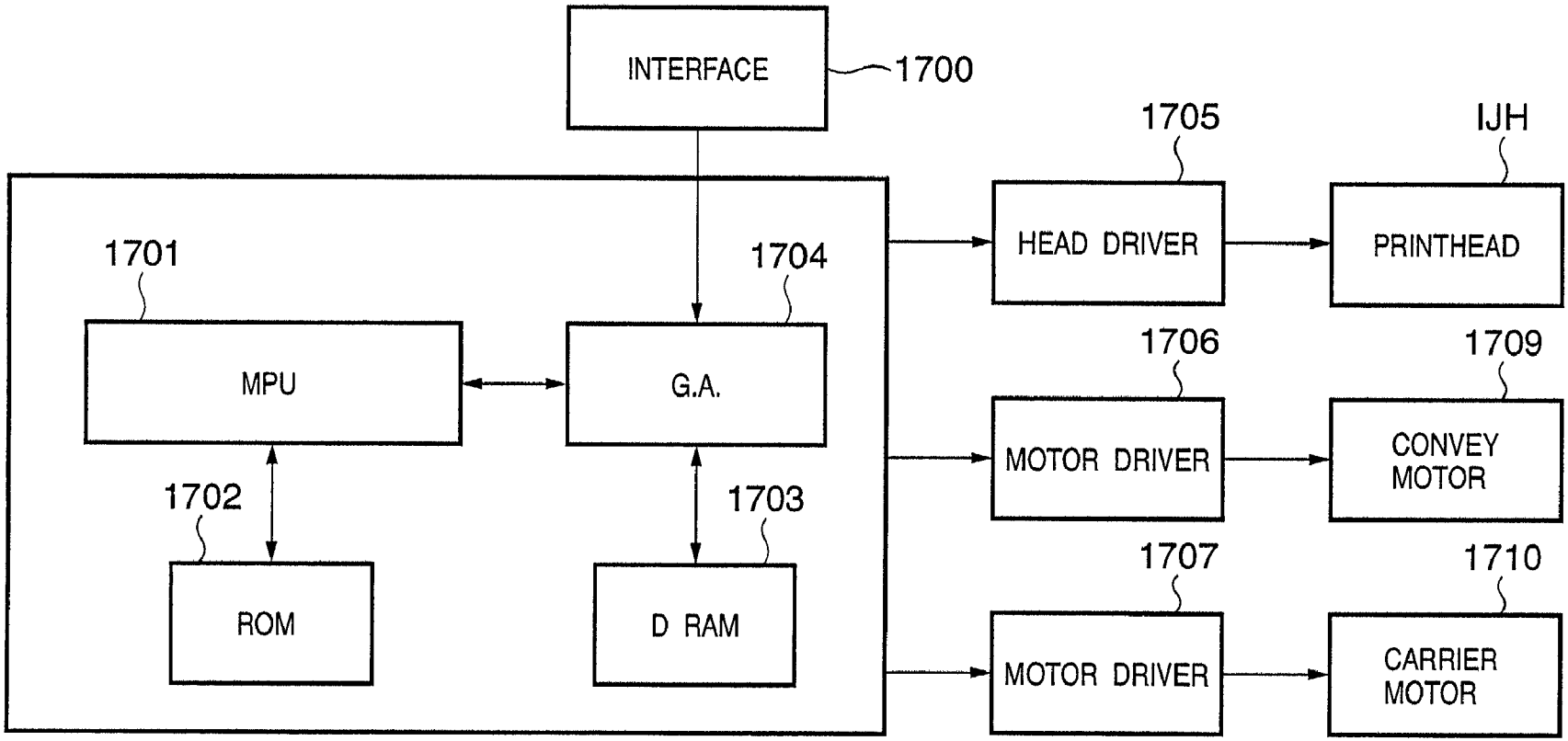
FIG. 11 is a block diagram showing the control arrangement of the printer in FIG. 10.

FIG. 11 is a block diagram showing the arrangement of a control circuit for the ink-jet printer IJRA. In FIG. 11 showing the control circuit, reference numeral 1700 denotes an interface for inputting a printing signal; 1701, an MPU; 1702, a ROM which stores a control program executed by the MPU 1701; 1703, a dynamic RAM for storing various data (printing signal, printing data supplied to the head, and the like); 1704, a gate array (G.A.) which controls supply of printing data to the printhead IJH, and also controls data transfer between the interface 1700, the MPU 1701, and the RAM 1703; 1710, a carrier motor for carrying the printhead IJH; 1709, a convey motor for conveying a printing sheet; 1705, a head driver for driving the printhead; and 1706 and 1707, motor drivers for respectively driving the convey motor 1709 and carrier motor 1710.

An operation with this control arrangement will be explained. When a printing signal is input to the interface 1700, the printing signal is converted into printing data between the gate array 1704 and the MPU 1701. Then, the motor drivers 1706 and 1707 are driven, and the printhead is driven in accordance with the printing data sent to the head driver 1705 to print the data.

In this embodiment, the control program executed by the MPU 1701 is stored in the ROM 1702. It can also be possible to add an erasable/writable storage medium such as an EEPROM and change the control program from a host computer connected to the ink-jet printer IJRA.

The ink tank IT and printhead IJH may be integrated into an exchangeable ink cartridge IJC, as described above. Alternatively, the ink tank IT and printhead IJH may be separately constituted, and when ink runs short, only the ink tank IT may be exchanged.

Figure 12:
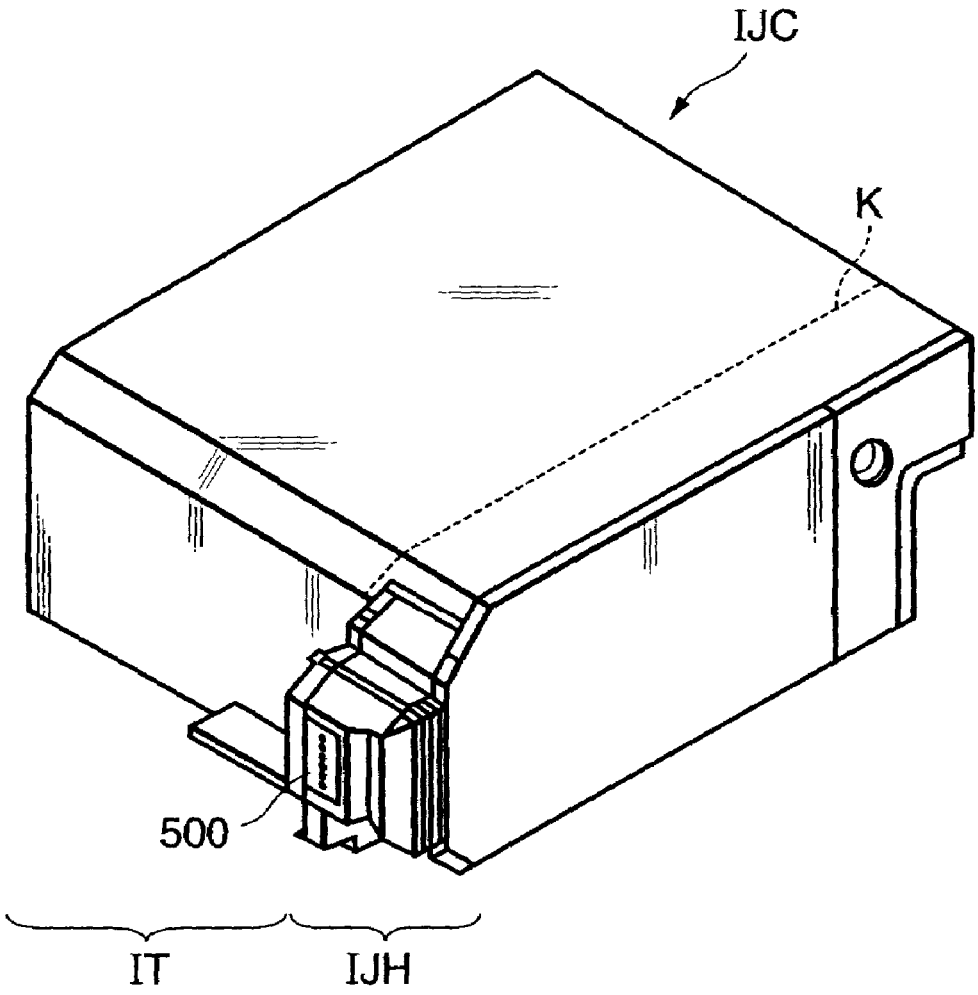
FIG. 12 is a perspective view showing the ink cartridge of the printer in FIG. 10.

FIG. 12 is a perspective view showing the outer appearance of the ink cartridge IJC separable into the ink tank and head. As shown in FIG. 12, the ink cartridge IJC can be separated into the ink tank IT and printhead IJH at a boundary K. The ink cartridge IJC has an electrode (not shown) for receiving an electrical signal supplied from the carriage HC when the ink cartridge IJC is mounted on the carriage HC. The printhead IJH is driven by the electrical signal to discharge ink, as described above.

In FIG. 12, reference numeral 500 denotes an ink orifice line. The ink tank IT has a fibrous or porous ink absorber in order to hold ink.

<First Embodiment: Oxide Film Thickness>

Figure 1A:
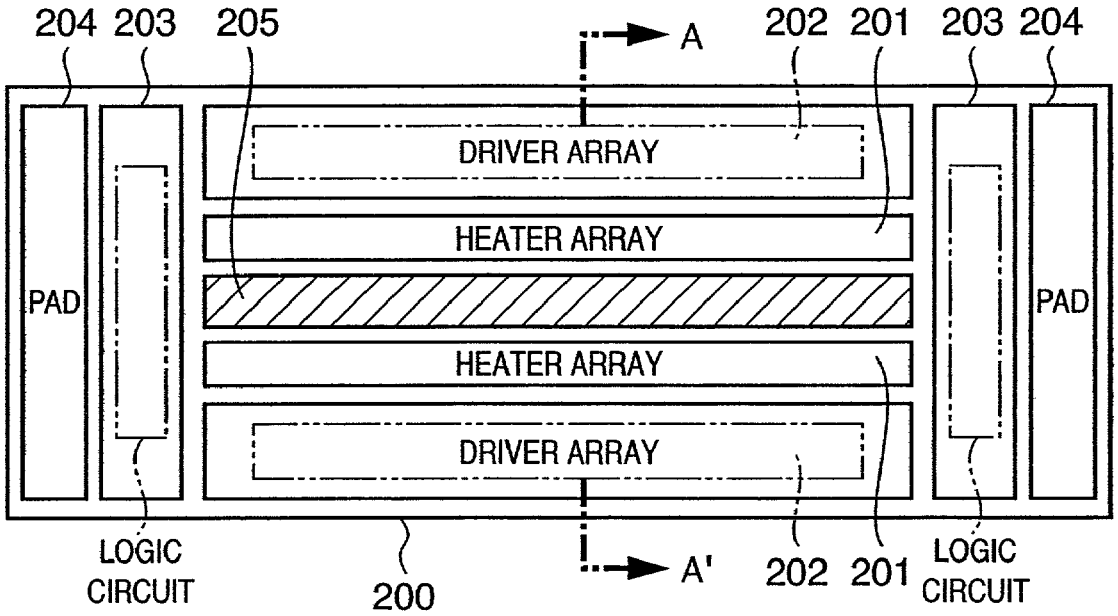
FIG. 1A is a block diagram for explaining the layout of a printhead board according to the present invention.

FIG. 1A shows a printhead board according to the first embodiment. Heater arrays 201 including 256-bit heaters, driver arrays 202 having drivers for driving the respective heaters, and logic circuits 203 for driving the drivers are formed on a single board 200. Pads 204 for electrically connecting the board to its outside are formed on the board 200.

Figure 3:
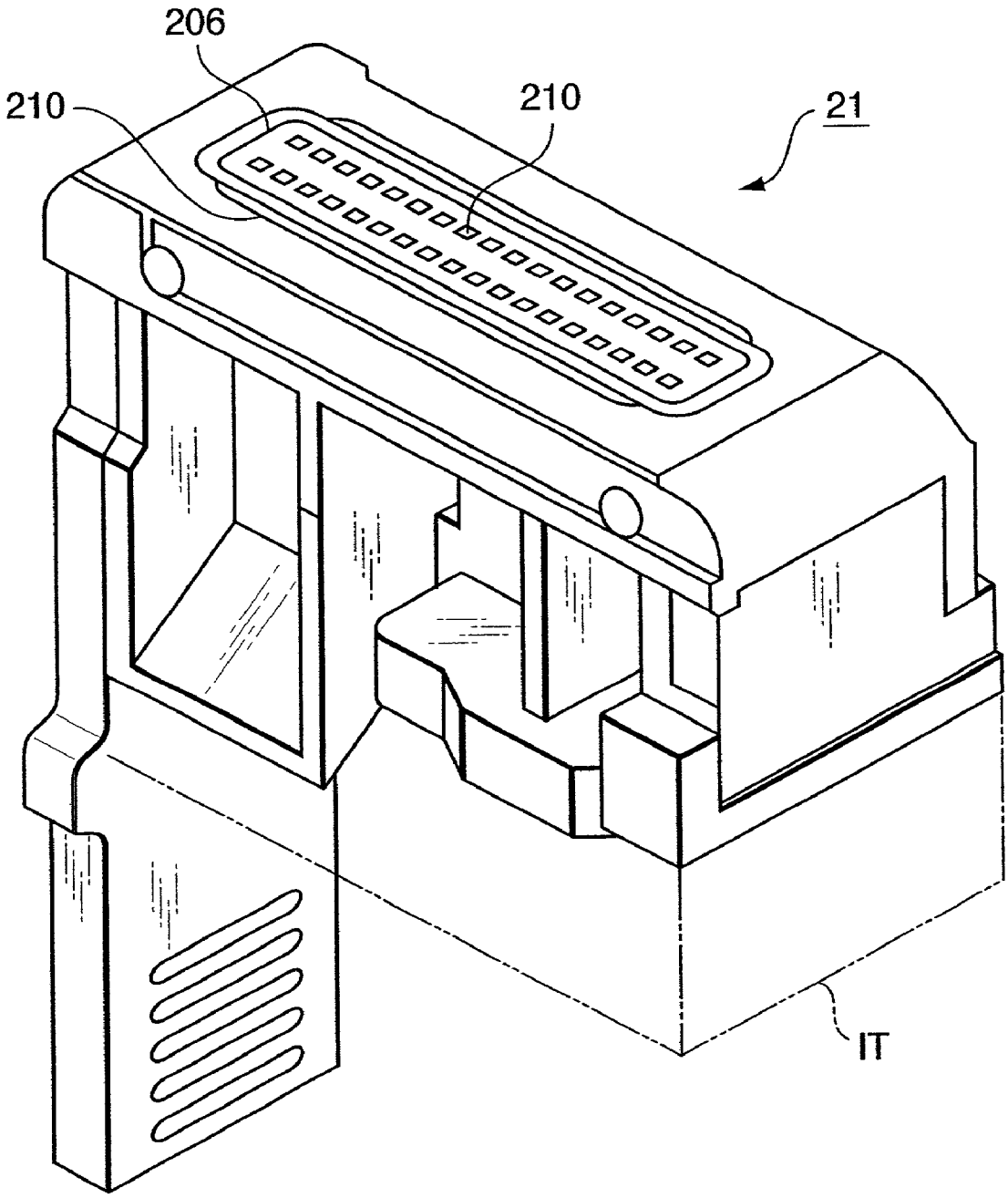
FIG. 3 is a perspective view showing the outer appearance of an example of a printhead constituted using a board according to an embodiment of the present invention.

FIG. 3 is a perspective view showing the outer appearance of an example of a printhead constituted using the printhead board according to the first embodiment. As shown in FIG. 3, the printhead has two lines of orifices 210 in correspondence with the heater arrays 201 arranged on the two sides of ink supply ports 205 shown in FIG. 1A. The orifices 210 are arranged in corresponding lines at a predetermined pitch on an orifice plate 206. The ink tank IT indicated by a two chain double-dashed line is detachably attached to the printhead of the first embodiment.

Figure 4:
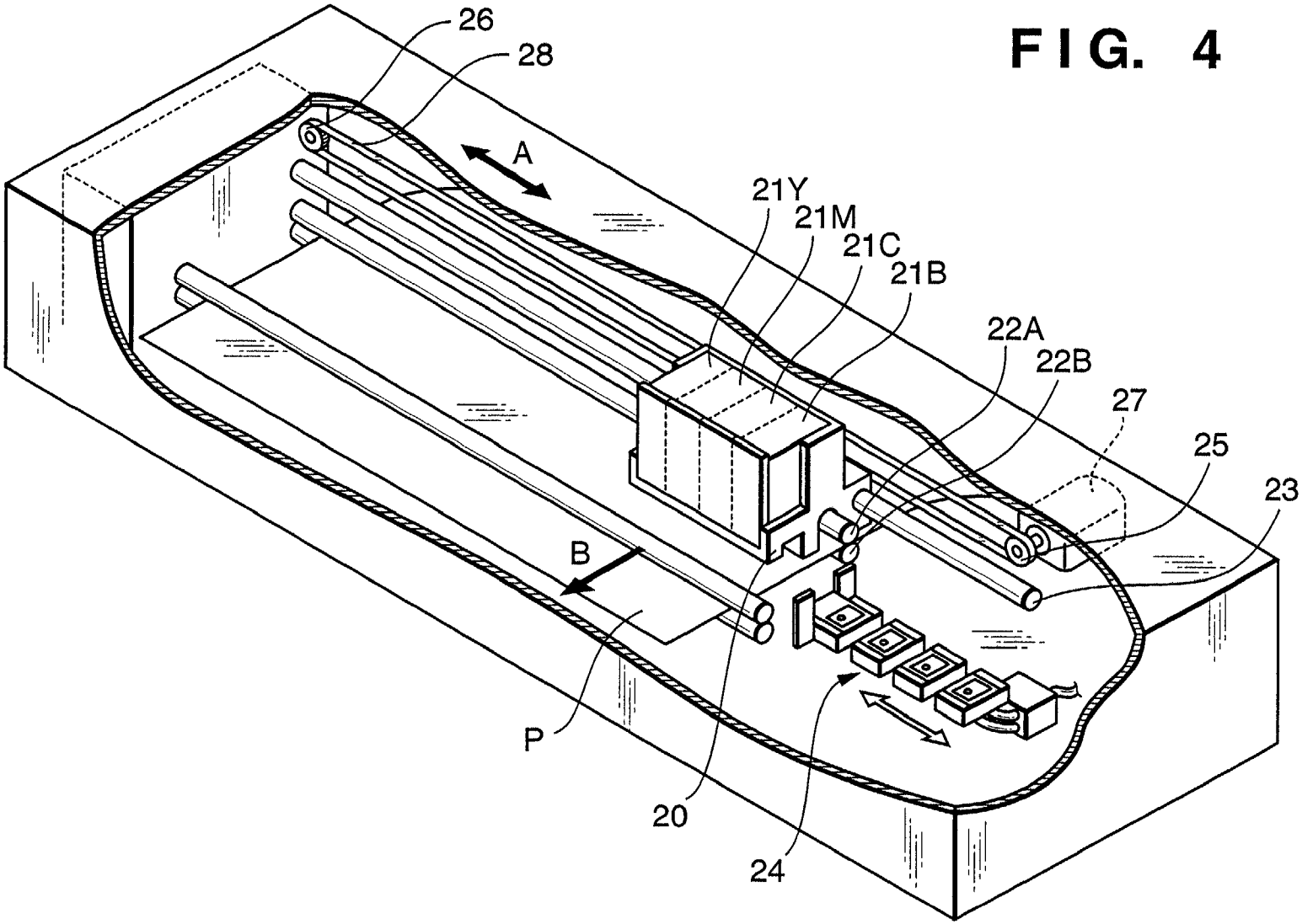
FIG. 4 is a schematic perspective view showing an example of an ink-jet printing apparatus on which the printhead and ink tank shown in FIG. 3 are mounted to print data.
Figure 5A:
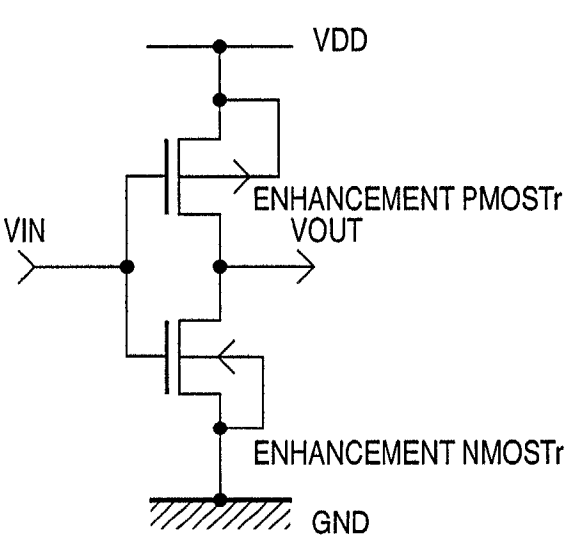
FIGS. 5A to 5C are circuit diagrams showing examples of power transistors formed on a board (HB)
Figure 5B:
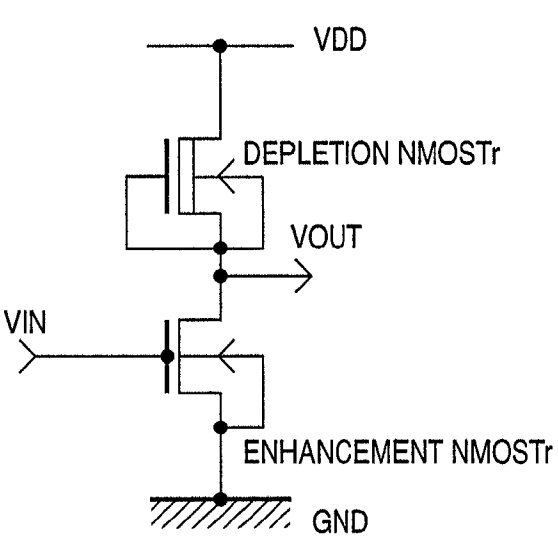
Figure 5C:
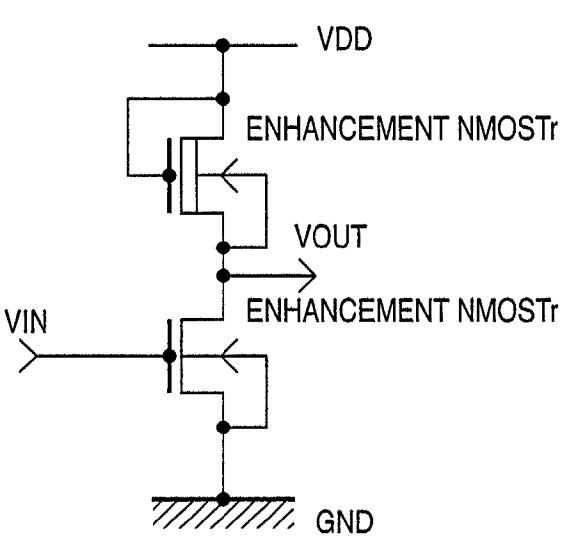
Figure 6A:
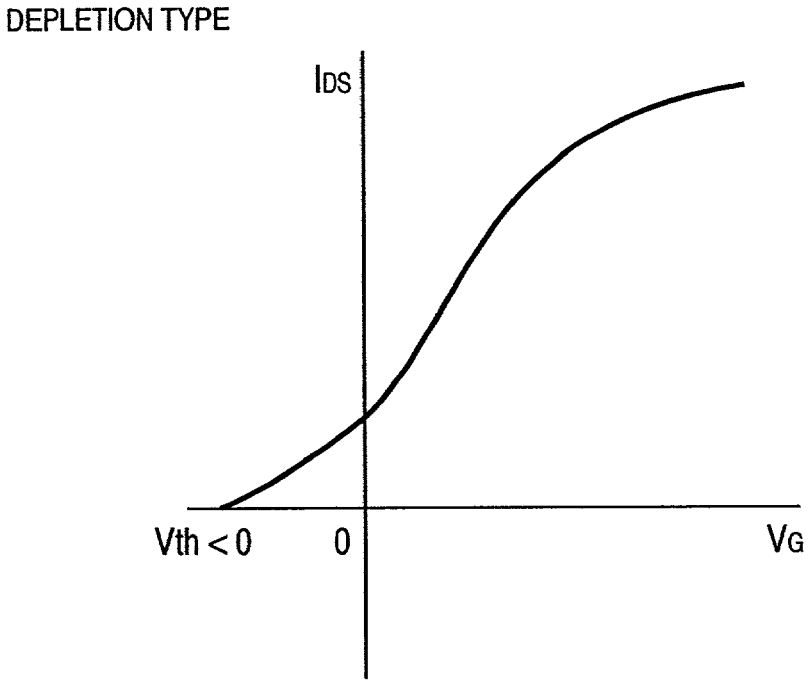
FIGS. 6A and 6B are graphs showing the transfer characteristic of an NMOS transistor.
Figure 6B:
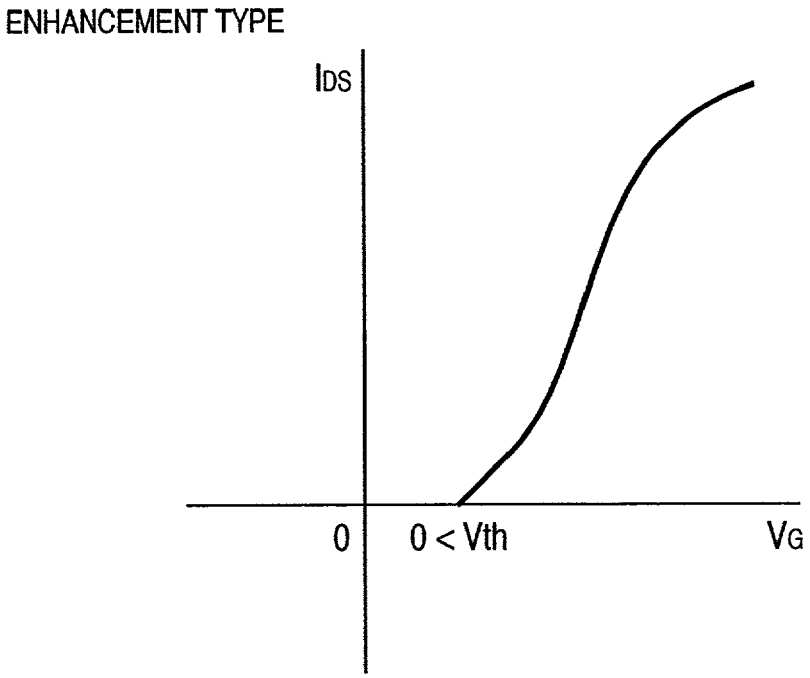
Figure 7A:
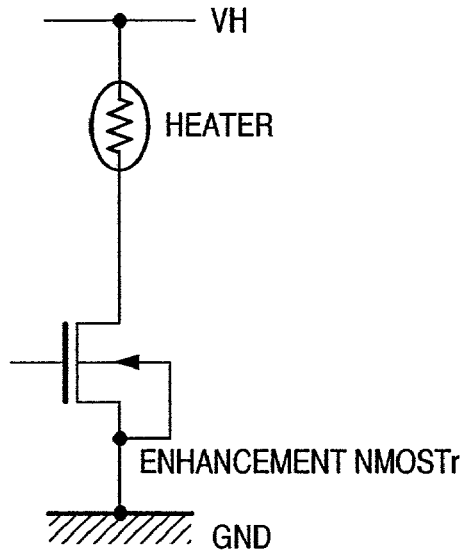
FIGS. 7A and 7B are views, respectively, showing an enhancement NMOS transistor connected to a heater and the structure of the transistor.
Figure 7B:
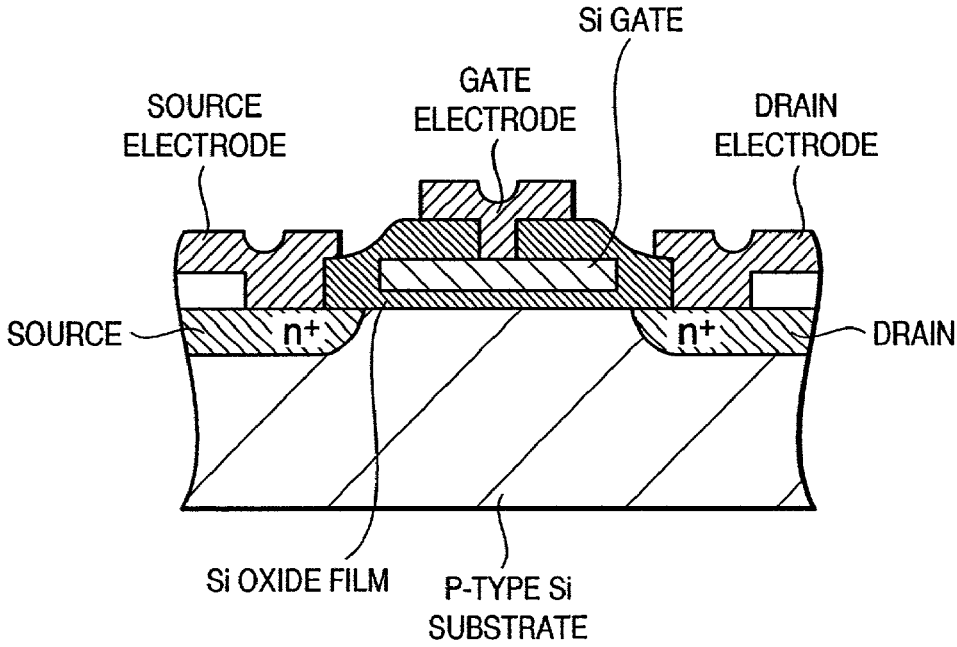
Figure 8:
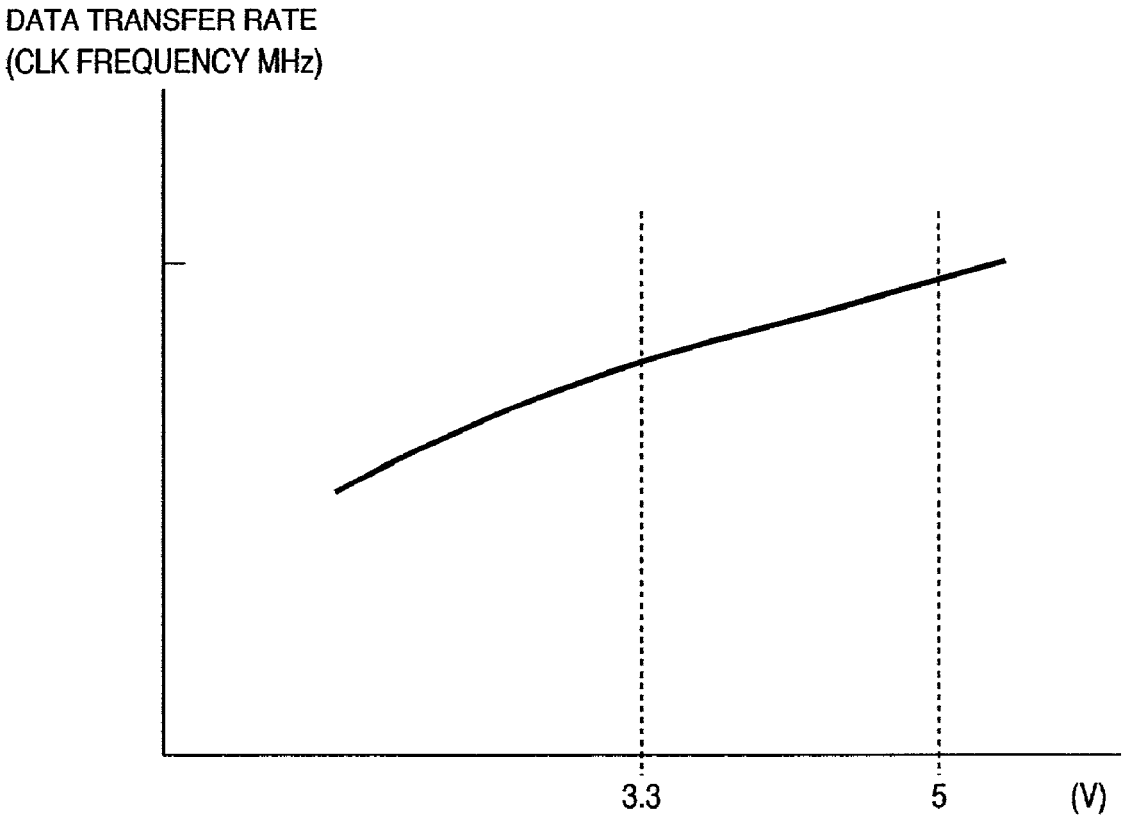
FIG. 8 is a graph qualitatively showing the relationship between the driving voltage and the data transfer rate.
Figure 9A:
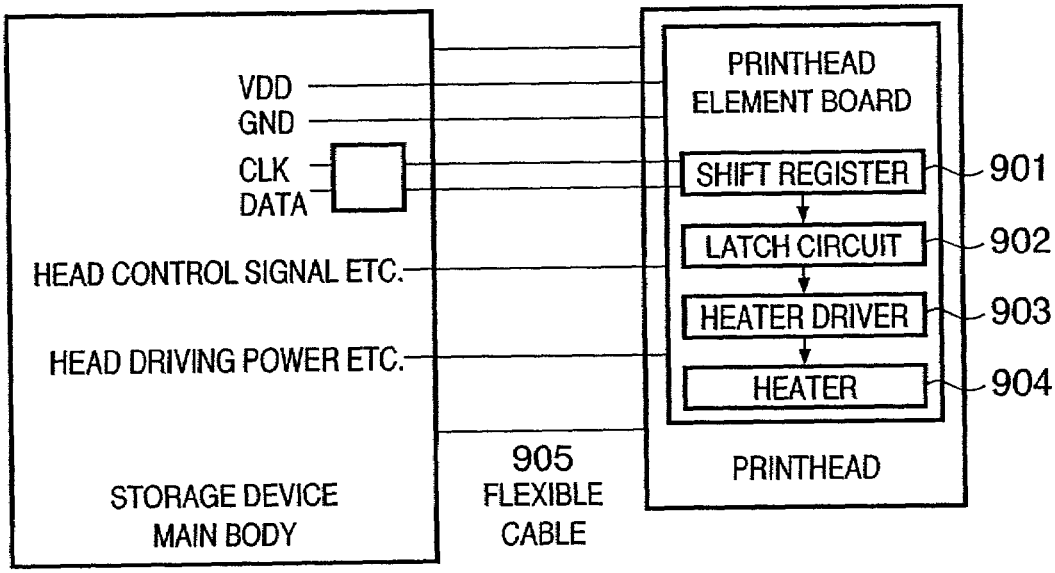
FIG. 9A is a block diagram for schematically explaining the connection between the printing apparatus main body and the printhead.
Figure 9B:
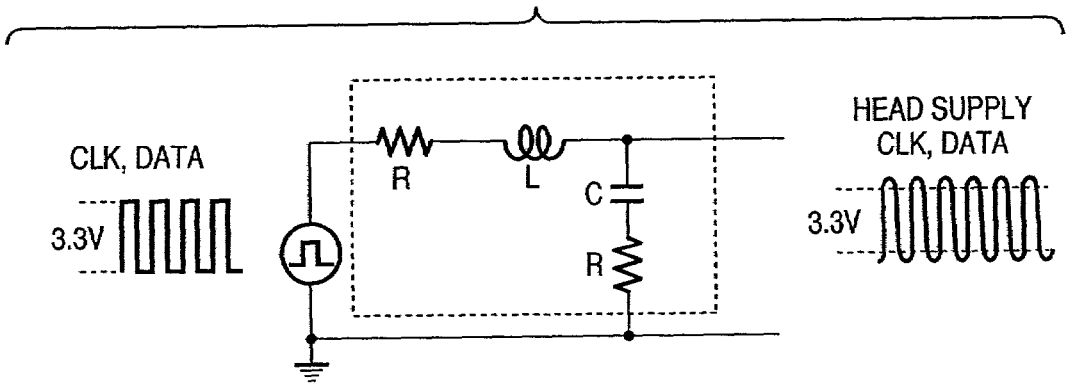
FIG. 9B is a circuit diagram showing an LCR circuit for equivalently expressing a circuit for outputting image data (DATA) and a clock (CLK)

FIG. 4 is a schematic perspective view showing an example of an ink-jet printing apparatus on which the printhead and ink tank shown in FIG. 3 are mounted to print data.

Printheads 21Y, 21M, 21C, and 21B (and their ink tanks IT) corresponding to yellow (Y), magenta (M), cyan (C), and black (B) inks are detachably mounted on a carriage 20. The carriage 20 slidably engages with a guide shaft 23, and receives the driving force of a motor 27 via pulleys 25 and 26 and a belt 28. The heads 21Y, 21M, 21C, and 21B can scan a printing sheet P serving as a target printing medium. A predetermined number of printing sheets P are conveyed by a pair of convey rollers 22A and 22B during scanning. A recovery unit 24 for performing discharge recovery processing of each printhead is attached at one end of the printhead moving range.

<Printhead Board Manufacturing Process>

Figure 13:
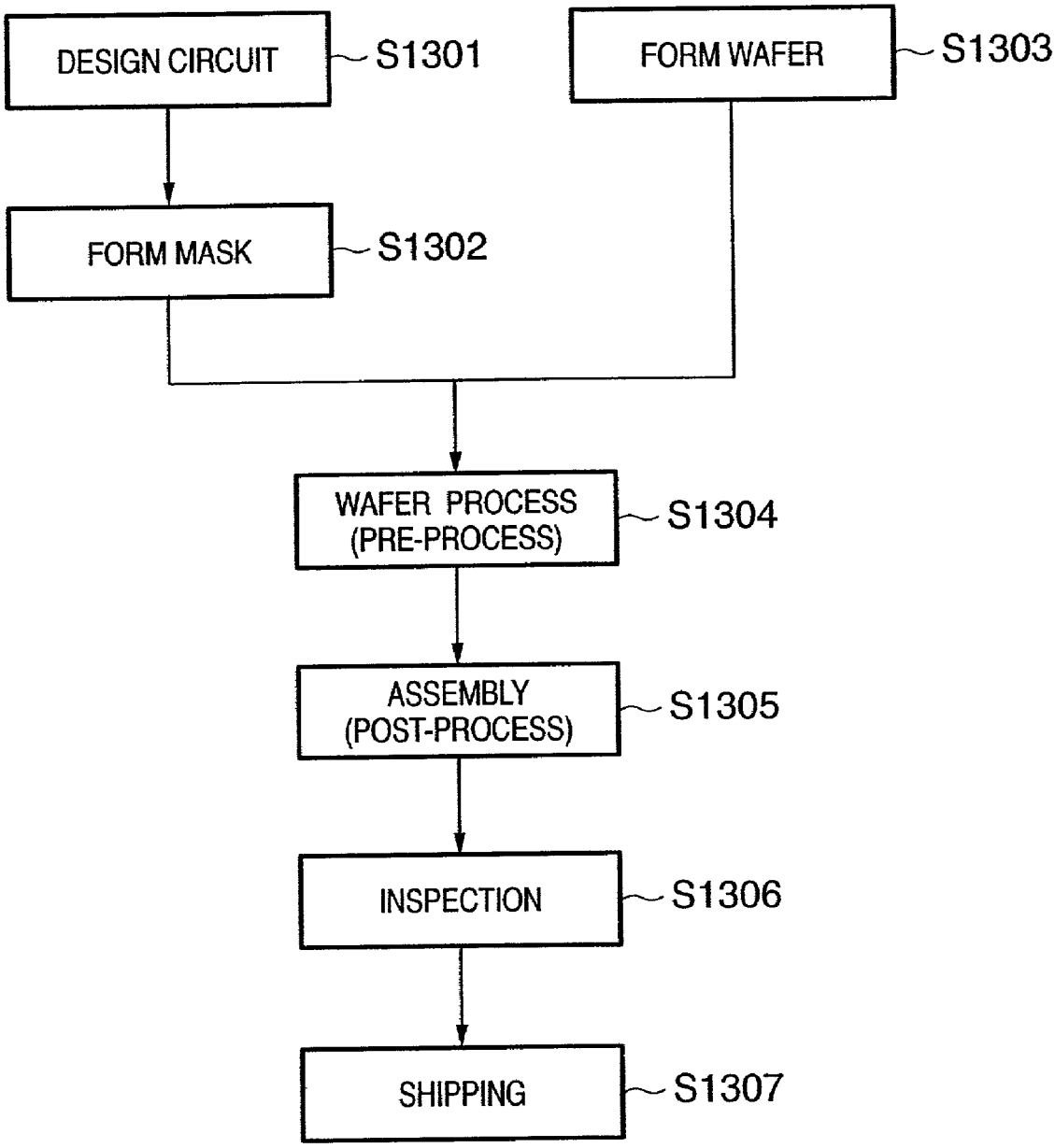
FIG. 13 is a flow chart for explaining the flow of a semiconductor device manufacturing process.

FIG. 13 shows the flow of the whole manufacturing process of the semiconductor device. In step S1301 (circuit design), a semiconductor device circuit is designed. In step S1302 (mask formation), a mask having the designed circuit pattern is formed. In step S1303 (wafer formation), a wafer is formed using a material such as silicon. In step S1304 (wafer process) called a pre-process, an actual circuit is formed on the wafer by lithography using the prepared mask and wafer.

Step S1305 (assembly) called a post-process is the step of forming a semiconductor chip by using the wafer formed in step S1304, and includes an assembly process (dicing and bonding) and packaging process (chip encapsulation). In step S1306 (inspection), the semiconductor device manufactured in step S1305 undergoes inspections such as an operation confirmation test and durability test. After these steps, the semiconductor device is completed and shipped (step S1307).

Figure 14:
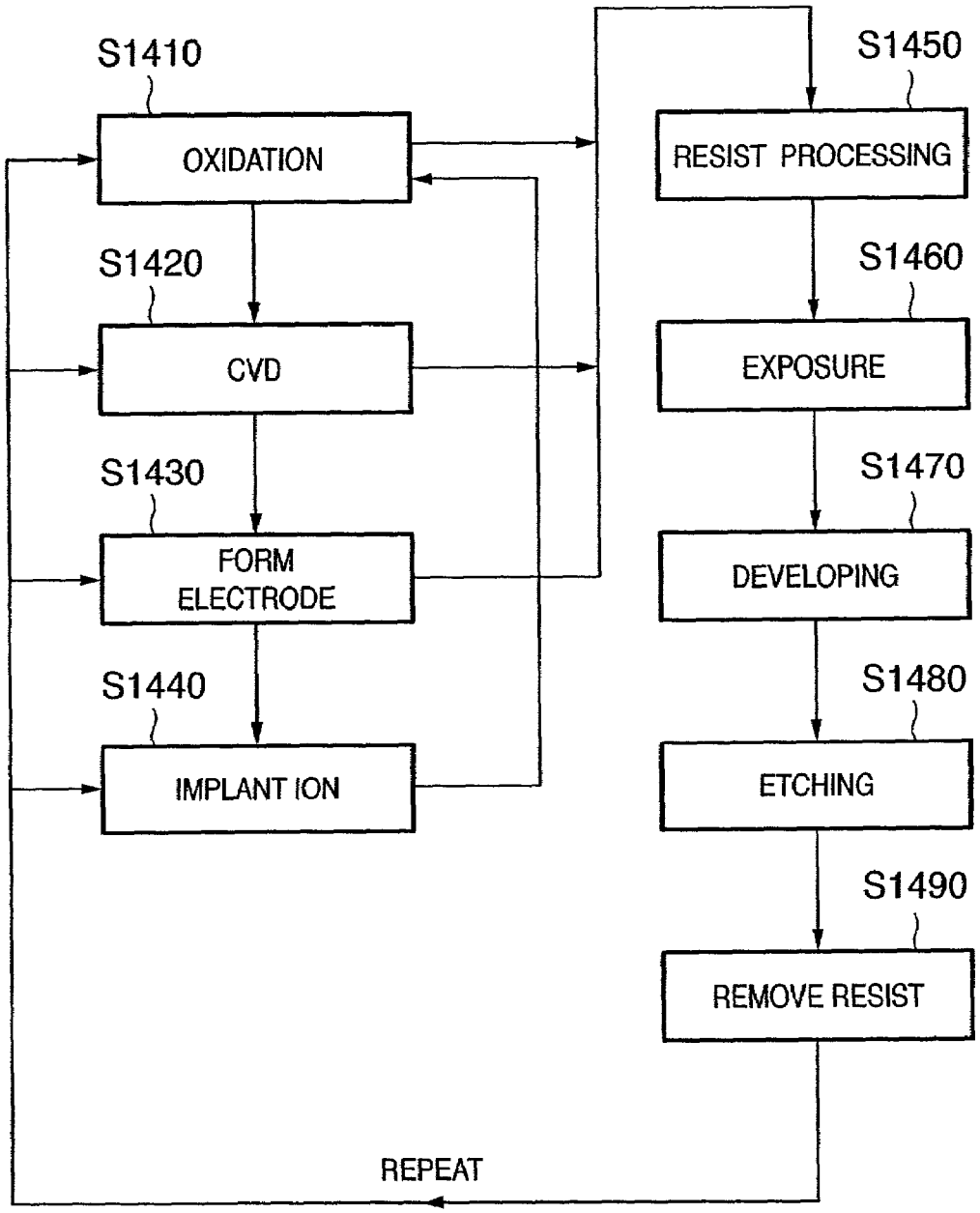
FIG. 14 is a flow chart for explaining a wafer process.
Figure 15:
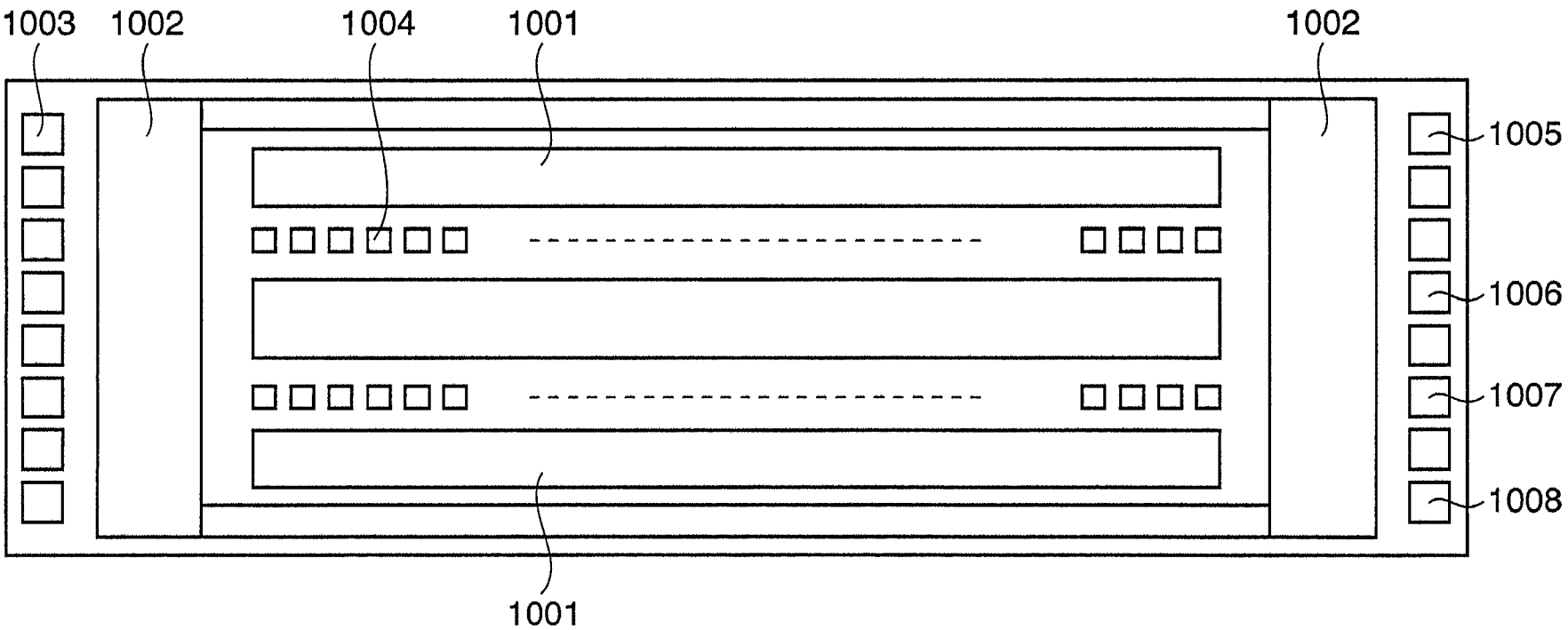
FIG. 15 is a view showing the layout of a conventional ink-jet printhead board.
Figure 16:
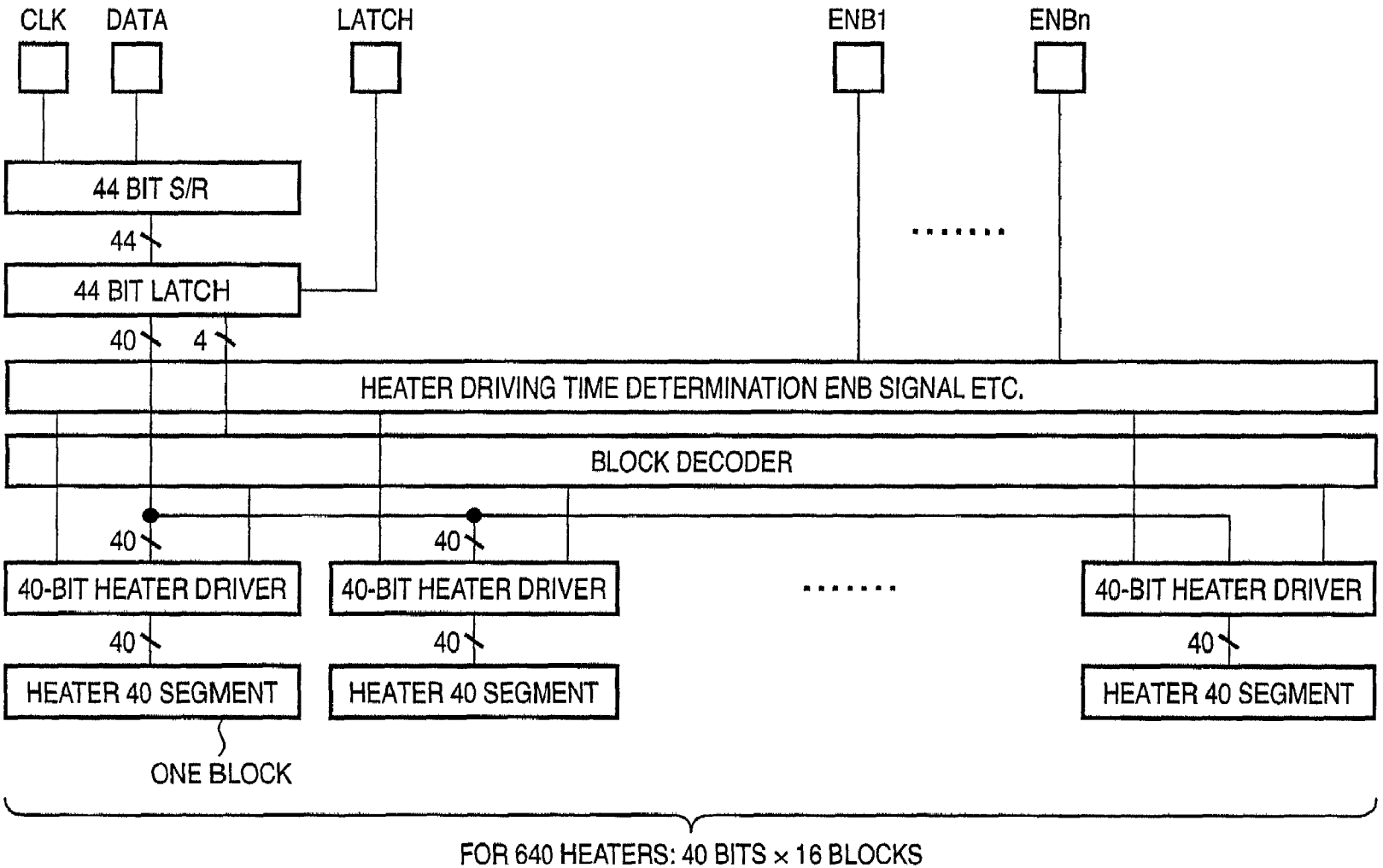
FIG. 16 is a block diagram showing the ink-jet printhead board.
Figure 17:
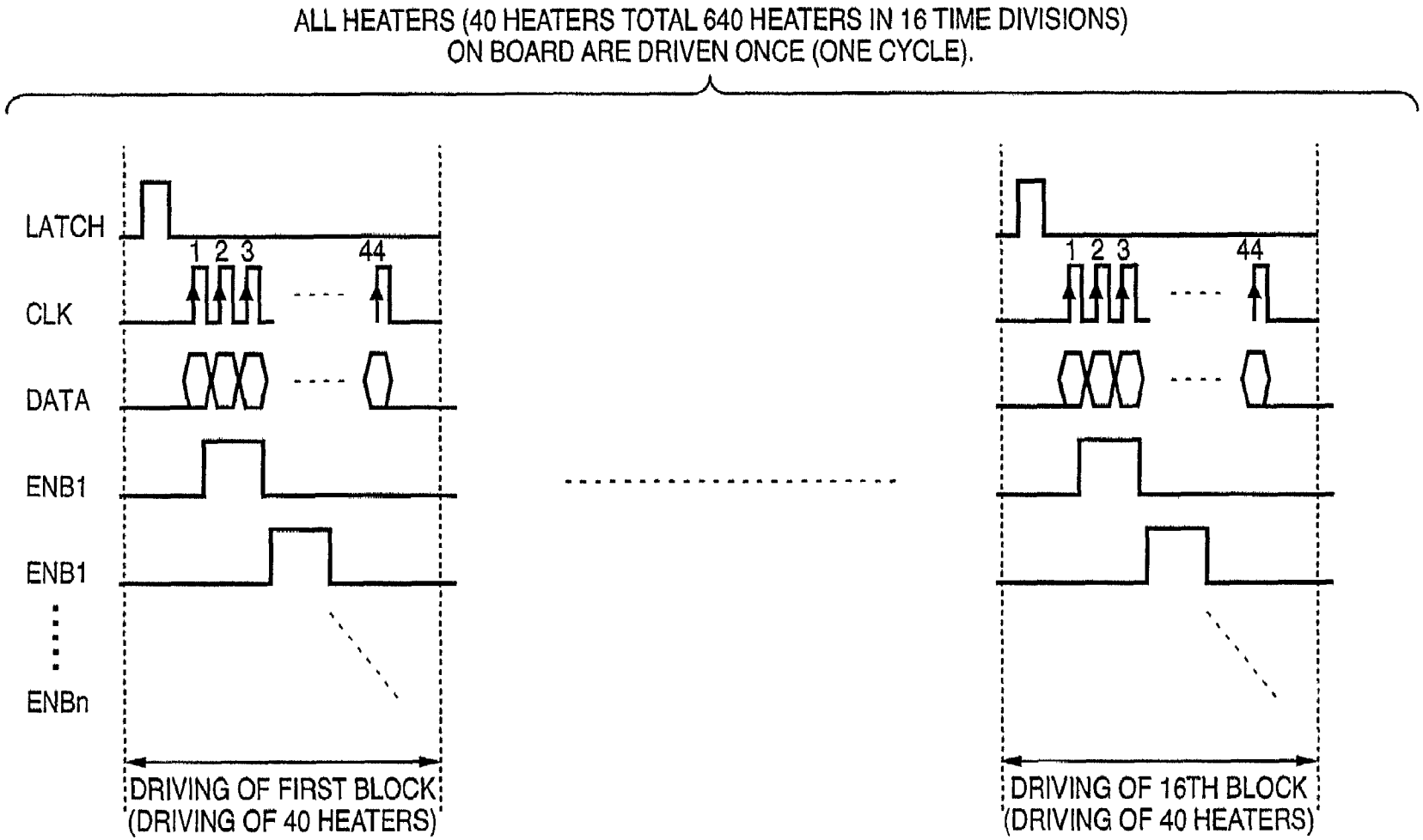
FIG. 17 is a timing chart for explaining the driving timing of the ink-jet printhead board.
Figure 18A:
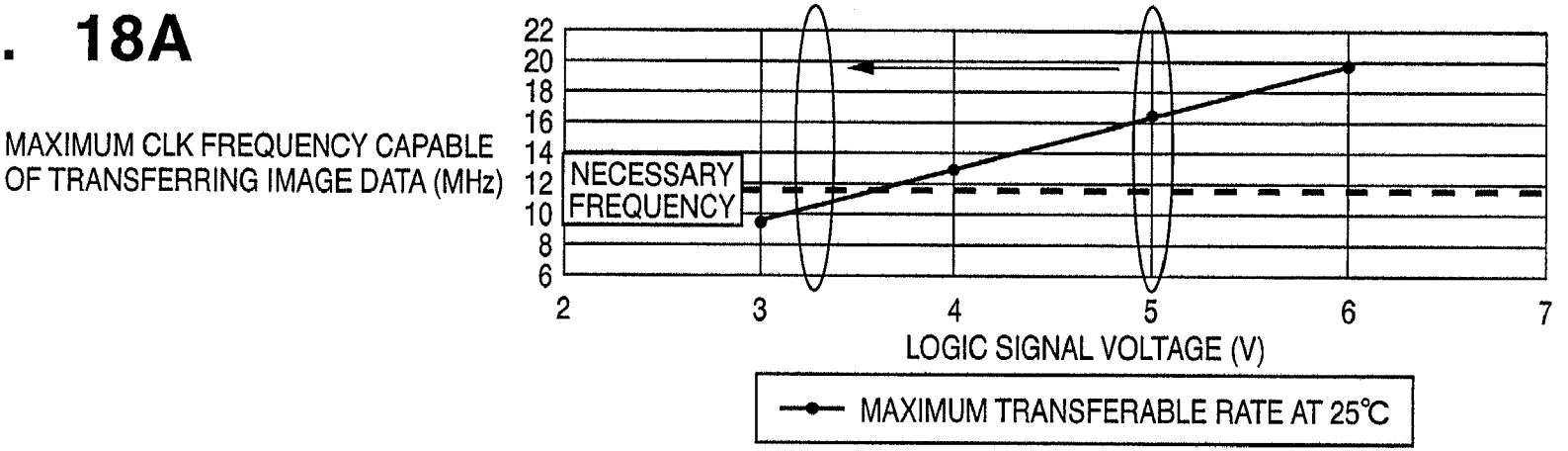
FIGS. 18A and 18B are graphs showing the maximum CLK frequency capable of transferring image data as a function of the logic power supply voltage.
Figure 18B:
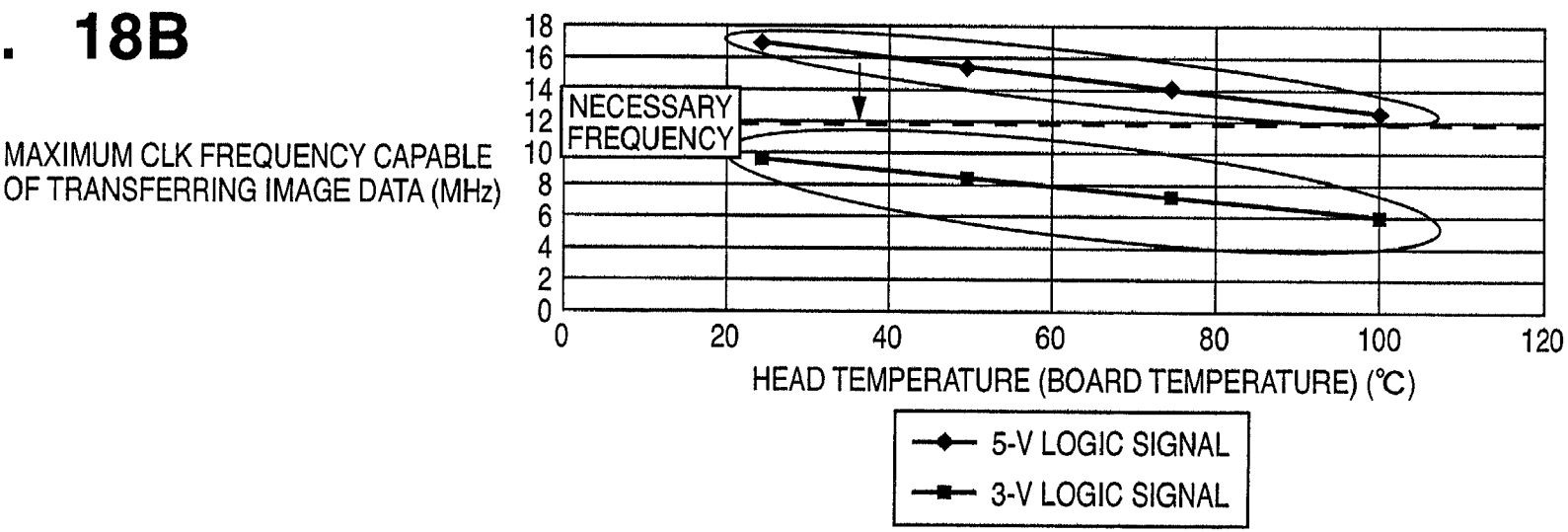

FIG. 14 shows the detailed flow of the wafer process (S1304).

In step S1410 (oxidation), the wafer surface is oxidized to form an oxide film. The threshold of an operating voltage at which the device operates changes depending on the formed oxide film thickness. By a plurality of oxidation processes, devices with difference oxide film thicknesses can be formed.

In step S1420 (CVD), an insulating film is formed on the wafer surface. In step S1430 (electrode formation), an electrode is formed on the wafer by vapor deposition.

In step S1440 (ion implantation), impurity atoms are ionized, and the ions are accelerated within the range of several to several hundred kV and implanted into the wafer. The threshold voltage of the transistor can be adjusted by applying ion implantation to channel doping of a MOS transistor.

In step S1450 (resist processing), a photosensitive agent is applied to the wafer.

In step S1460 (exposure), an exposure apparatus exposes the wafer to the circuit pattern of a mask, and prints the circuit pattern on the wafer. In step S1470 (developing), the exposed wafer is developed. In step S1480 (etching), the resist is etched except for the developed resist image. In step S1490 (resist removal), an unnecessary resist after etching is removed. These steps are repeated to form multiple circuit patterns on the wafer.

Figure 19A:
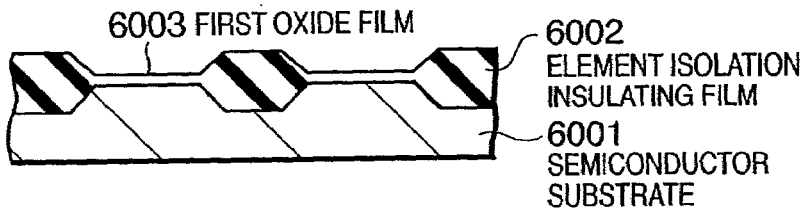
FIGS. 19A to 19F are sectional views for explaining the step flow of a typical process of forming transistors with different oxide film thicknesses on a single substrate.

The step flow of a typical process of forming transistors with different oxide film thicknesses on a single substrate will be described with reference to the sectional views of the substrate in FIGS. 19A to 19F. An element isolation region (LOCOS) having an element isolation insulating film 6002 and an element region having a first oxide film 6003 are formed on a semiconductor substrate 6001 by thermal oxidation (FIG. 19A).

Figure 19B:
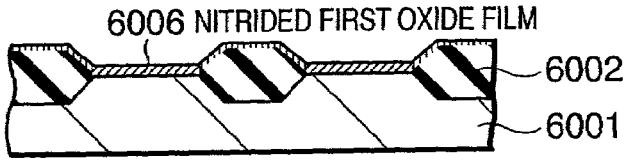

Annealing is performed in a nitrogen gas atmosphere to nitride the entire surface (FIG. 19B).

Figure 19C:
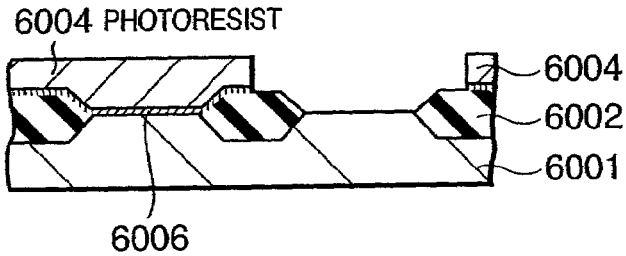
Figure 19D:
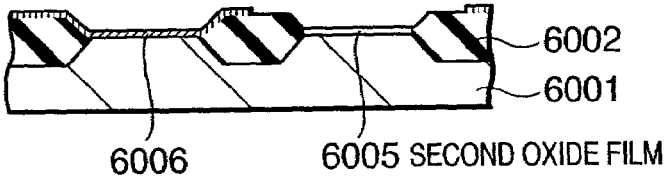

A first oxide film 6006 selectively nitrided using a photoresist 6004 is removed with, e.g., hydrofluoric acid (FIG. 19C). Then, a second oxide film 6005 is formed by thermal oxidation. At this time, the nitrided first oxide film 6006 is hardly oxidized and does not increase in film thickness (FIG. 19D).

Figure 19E:
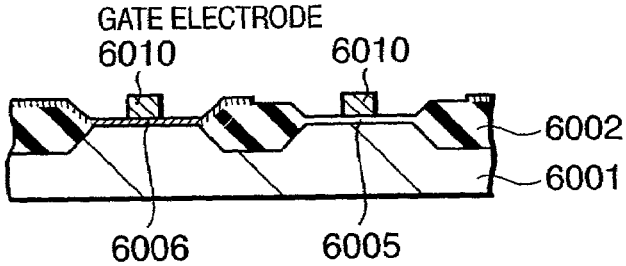
Figure 19F:
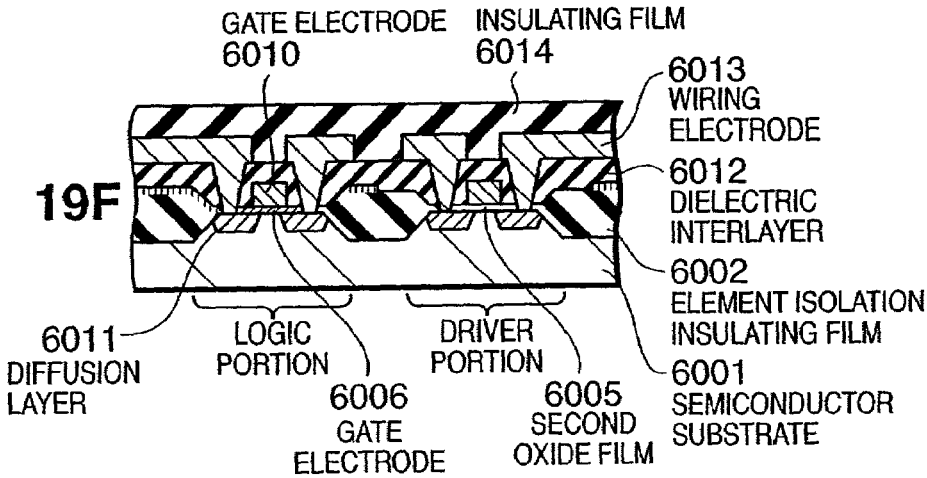

A gate electrode 6010 is formed from a poly-Si film (FIG. 19E). Diffusion layers 6011 serving as a source and drain are formed, and a dielectric interlayer 6012 is formed. A contact hole is formed to form a wiring electrode 6013, and an insulating film 6014 is formed on the resultant structure (FIG. 19F). After that, a heater necessary for the printhead and an insulating film serving as an uppermost protective film are formed to complete the steps.

A so-called channel doping step of diffusing an impurity with different concentrations to below the gate electrode may be inserted in order to control the threshold voltage of the transistor. In this case, an impurity may be diffused into the entire surface at a portion a in FIGS. 19A to 19F after formation of the first oxide film. Alternatively, an impurity may be diffused using a mask for either one of logic and driver portions at the portion a in FIGS. 19A to 19F after formation of the first oxide film. Alternatively, an impurity may be diffused by using separate masks (separately for the logic and driver portions). Considering the influence of annealing in the subsequent step, the channel doping step may be inserted immediately before formation of the gate electrode.

<Adjustment of Threshold Voltage by Oxide Film Thickness>

As the characteristic of a MOS transistor, an operating voltage threshold Vth is given by $$Vth=VFB+2\phi F+2TOX\cdot(1/\epsilon OX)\cdot\sqrt{(q\cdot\epsilon Si\cdot NA\cdot\phi F)} \quad (1)$$

VFB: flat band voltage

ϕF: Fermi level of channel region

TOX: oxide film thickness

ϵOX: permittivity of oxide film q: charge amount of electrons

ϵSi: permittivity of Si

NA: channel impurity concentration

The oxide film thickness in equation (1) is set as a key parameter, and the process in the step S1410 of FIG. 14 adopts a process of changing the oxide film thickness TOX. In this case, the oxidation step of forming a specific film thickness, which is equivalent to step S1410, may be applied a plurality of number of times. By applying a specific oxidation step to a device, a desired film thickness can be formed for each device. This enables changing the operation threshold of an enhancement NMOS transistor which constitutes a driver for driving a heater, and the operation threshold of an enhancement NMOS transistor which constitutes a logic circuit for driving the driver.

Figure 2A:
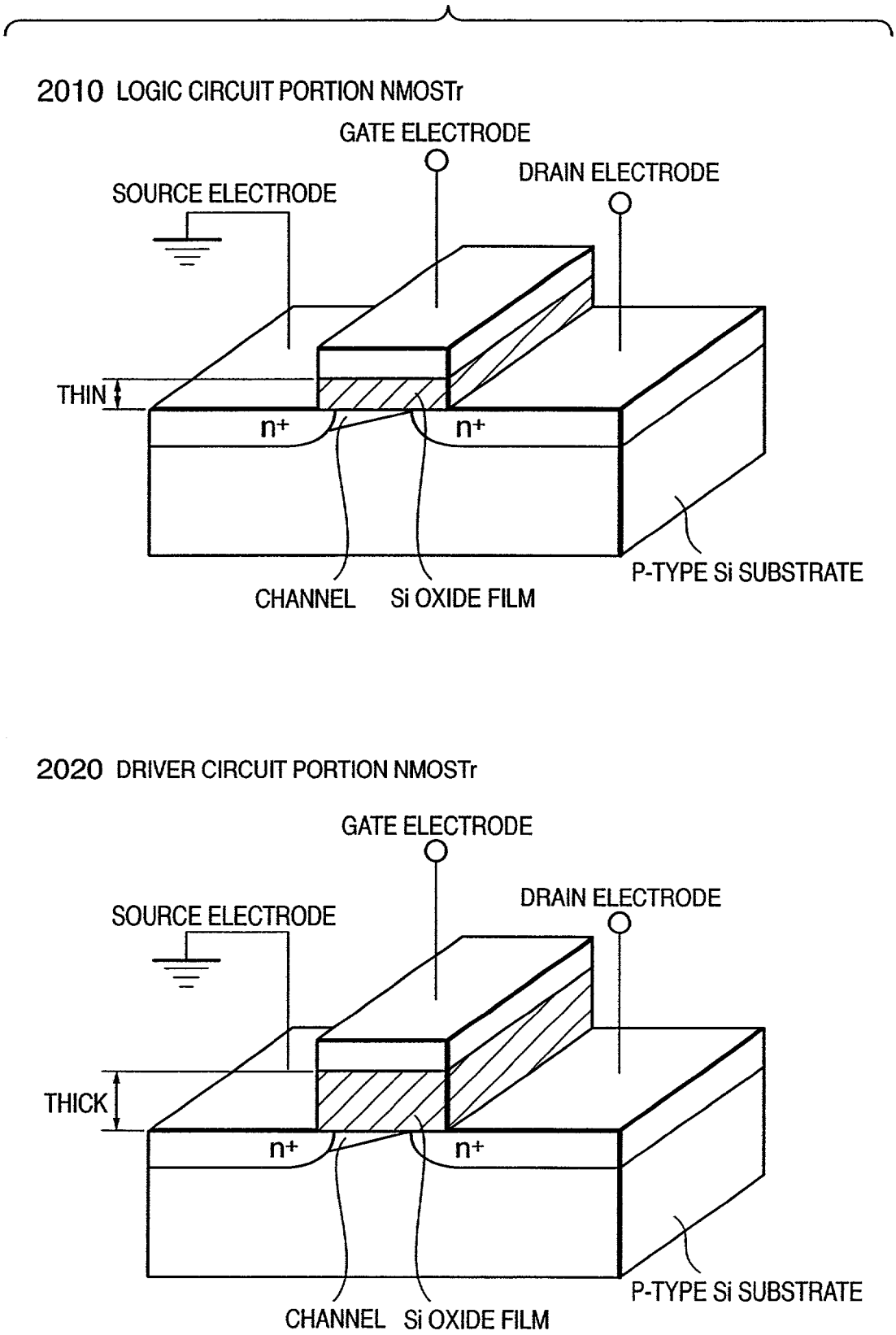
FIG. 2A is a view schematically showing the NMOS transistors of logic and driver circuit portions with different oxide film thicknesses.

From the relation in equation (1), the operating voltage threshold of the transistor is higher for a larger oxide film thickness TOX. 2010 and 2020 in FIG. 2A are views schematically showing the NMOS transistors of the logic and driver circuit portions having different oxide film thicknesses.

In the first embodiment, as shown in 2020 of FIG. 2A, the enhancement NMOS transistor which constitutes the driver is formed with a gate oxide film thickness of 70 nm. As shown in 2010 of FIG. 2A, the enhancement NMOS transistor which constitutes the logic circuit is formed with a gate oxide film thickness of 35 nm.

The oxide film thickness on the driver side is larger than that of the transistor on the logic circuit side. The threshold of a device formed under these conditions is higher on the driver side by 1.5 V. When a current of 140 mA per heater bit flows and heaters of 16 bits at maximum are instantaneously driven at the same time, about 2.2 A is switched and noise of about 0.5 V is generated on the board. However, the driver can stably operate without any malfunction.

Since the logic circuit is smaller in oxide film thickness than the driver circuit, the threshold becomes lower. The drivability of the element can be improved even at a voltage of 3.3 V or lower supplied from the apparatus main body. Even if the power supply voltage is changed from 5 V to 3.3 V, the printing apparatus can maintain a data transfer rate of 12 MHz or higher and cope with high-speed printing.

According to the first embodiment, the oxide film thickness of the driver portion can be set larger than that of a conventional driver. The breakdown voltage can also be increased in addition to the drivability. Consequently, the current can be decreased, and any loss and noise can be reduced.

<Second Embodiment: Channel Impurity Concentration>

The arrangement of a printhead board according to the second embodiment is identical to that of FIG. 1A in the first embodiment, and a detailed description thereof will be omitted.

To prevent the malfunction of a heater element and prevent an abnormal current from flowing, the second embodiment controls the operating voltage threshold of a transistor by using the channel impurity concentration NA in equation (1) as a key parameter in processing of step S1440 of FIG. 14. More specifically, the operation threshold of an enhancement NMOS transistor which constitutes a driver for driving a heater, and the operation threshold of an enhancement NMOS transistor which constitutes a logic circuit for driving the driver are changed as follows. The channel impurity concentration NA is changed to control the channel impurity concentrations of the two transistors so as to maintain the printing performance of the ink-jet printing apparatus.

From the relation in equation (1), the threshold Vth is higher for a higher channel impurity concentration NA.

Figure 2B:
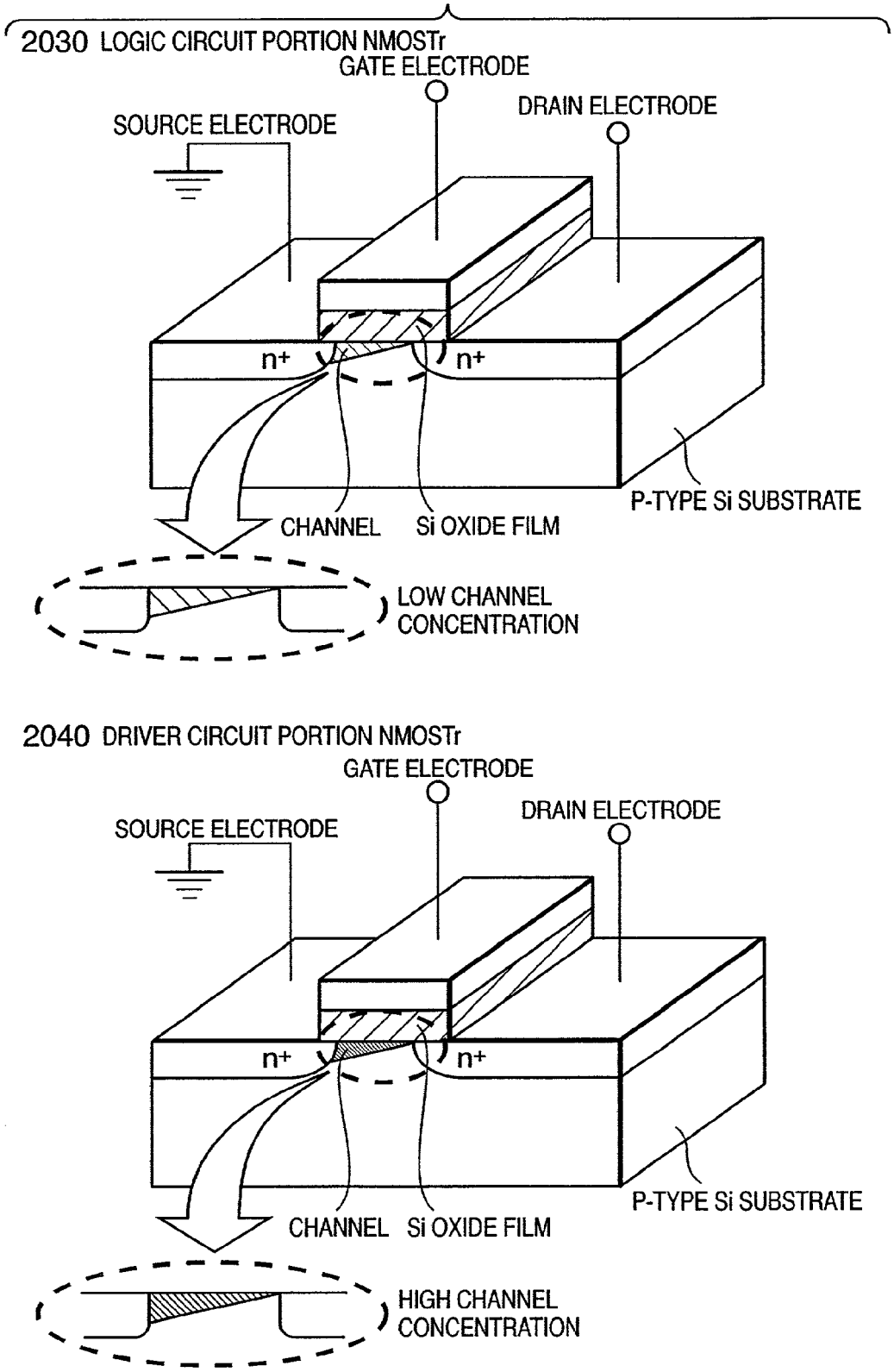
FIG. 2B is a view schematically showing the NMOS transistors of the logic and driver circuit portions with different channel impurity concentrations.

2030 and 2040 in FIG. 2B are views schematically showing the NMOS transistors of the logic and driver circuit portions having different channel concentrations. In forming the gates of the enhancement NMOS transistors of the driver and logic circuit, the B ion implantation amount is controlled to set the channel impurity concentration NA to be high (heavy) for the transistor of the driver and low (light) for the transistor of the logic circuit.

In this case, the channel impurity concentration on the driver side is higher than that on the logic circuit side. The threshold on the driver side is higher by 1.5 V than that on the logic side. When a current of 140 mA per heater bit flows and heaters of 16 bits at maximum are instantaneously driven at the same time, about 2.2 A is switched and noise of about 0.5 V is generated on the board. However, the driver can stably operate without any malfunction.

Since the logic circuit is lower in channel impurity concentration than the driver circuit, the threshold becomes lower. The drivability can be improved even at a voltage of 3.3 V or lower supplied from the apparatus main body. Even if the power supply voltage is changed from 5 V to 3.3 V, the printing apparatus can maintain a data transfer rate of 12 MHz or higher and cope with high-speed printing.

The second embodiment can be achieved only by controlling the channel concentration of the logic circuit in a conventional manufacturing process. The printhead board can be manufactured more easily than the first embodiment.

<Third Embodiment: Oxide Film Thickness+Channel Impurity Concentration>

To prevent the malfunction of a heater element and prevent an abnormal current from flowing, the third embodiment controls the operating voltage threshold of a transistor by using control of the oxide film thickness TOX and the channel impurity concentration NA in equation (1) as key parameters in steps S1401 and S1440 of FIG. 14. More specifically, the operation threshold of an enhancement NMOS transistor which constitutes a driver for driving a heater, and the operation threshold of an enhancement NMOS transistor which constitutes a logic circuit for driving the driver are changed as follows. The oxide film thickness and channel impurity concentration NA are changed in a superposition manner to control the threshold voltages of the two transistors so as to maintain the desired printing performance of the ink-jet printing apparatus.

Figure 1B:
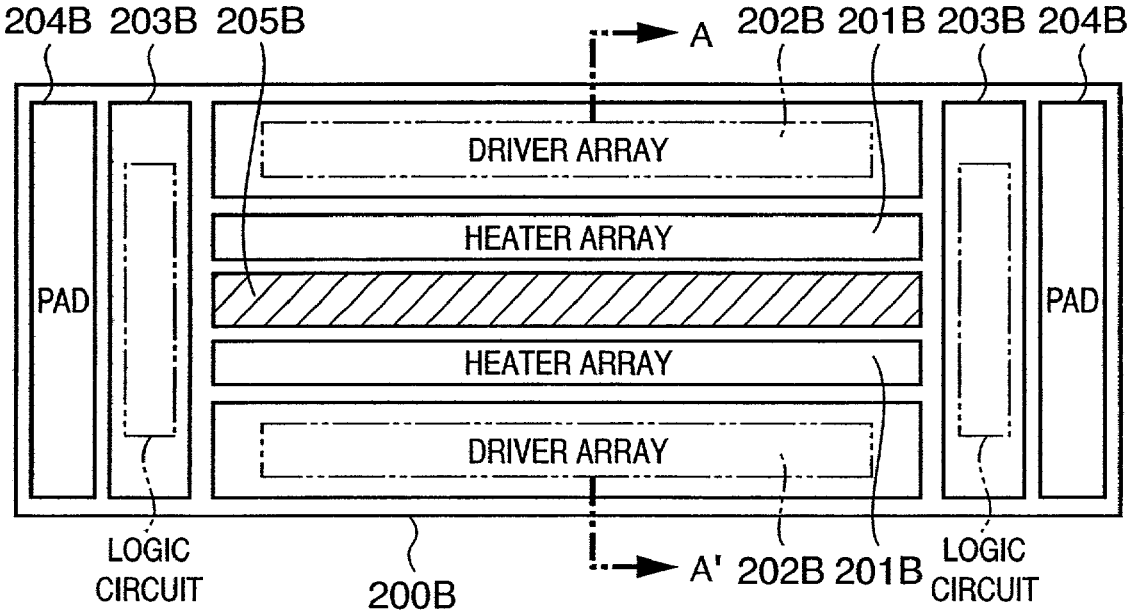
FIG. 1B is a block diagram for explaining the layout of another printhead board according to the present invention.

In FIG. 1B showing an ink-jet printhead board according to the third embodiment, heater arrays 201B including 512-bit heaters, driver arrays 202B having drivers for driving the respective heaters, and logic circuits 203B for driving the drivers are formed on a single board 200B. Pads 204B for electrically connecting the board to its outside are formed on the board 200B. Ink supply ports 205B are formed at the center of the board.

Figure 2C:
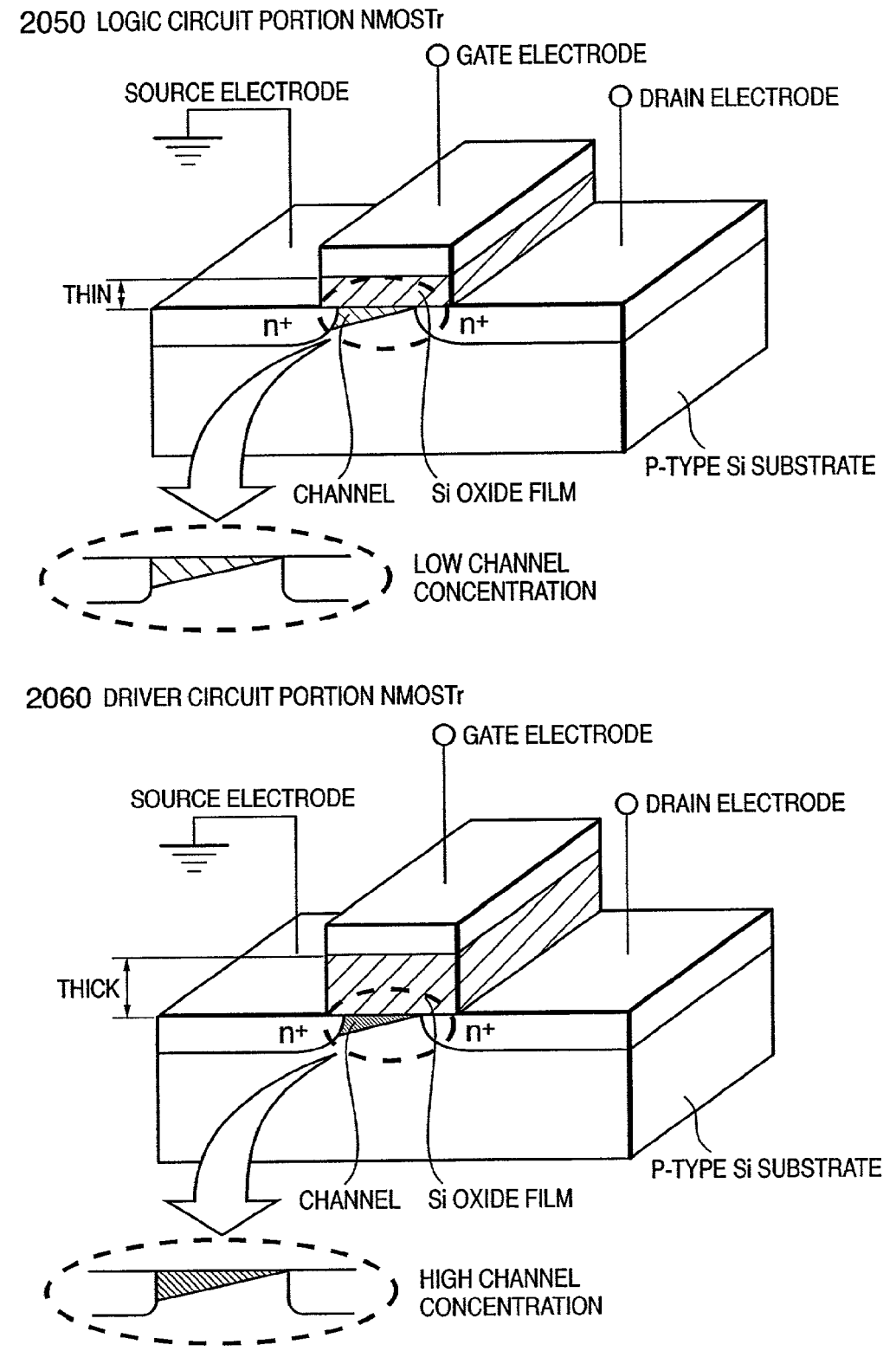
FIG. 2C is a view schematically showing the NMOS transistors of the logic and driver circuit portions with different oxide film thicknesses and different channel impurity concentrations.

2050 and 2060 in FIG. 2C are views schematically showing the NMOS transistors of the logic and driver circuit portions having different oxide film thicknesses and different channel impurity concentrations.

In the third embodiment, as shown in 2060 of FIG. 2C, the enhancement NMOS transistor which constitutes the driver is formed with a gate oxide film thickness of 70 nm and a high (heavy) channel impurity concentration.

In equation (1), the operating voltage threshold of the NMOS transistor is higher for a larger oxide film thickness TOX. The threshold Vth increases as the channel impurity concentration NA increases.

The oxide film thickness and channel impurity concentration are selected and changed as parameters to be controlled. The superposition effect of the two parameters can change the thresholds of the respective devices.

Accordingly, an element in which the driver has a higher threshold than that adjusted by either parameter can be formed. When a current of 140 mA per heater bit flows and heaters of 32 bits at maximum are instantaneously driven at the same time, about 4.4 A is switched and noise of about 1.0 V is generated on the board. However, the driver can stably operate without any malfunction.

The enhancement NMOS transistor which constitutes the logic circuit is formed with a gate oxide film thickness of 10 nm and a lower channel impurity concentration. In this case, an element with a lower threshold than that adjusted by either parameter can be formed. The drivability of the element can be improved even at a power supply voltage of 2 V or lower supplied from the apparatus main body. The printing apparatus can maintain a data transfer rate of 20 MHz to 30 MHz and cope with high-speed printing.

The third embodiment separately sets the gate oxide film thickness and channel impurity concentration, and can set the threshold by an optimal combination of them. This embodiment can provide a board which can cope with high-speed printing while a large current is stably switched.

As for the setting of the channel impurity concentration, the impurity concentration at the channel portion of the enhancement NMOS transistor which forms the driver is set higher than that at the channel portion of the enhancement NMOS transistor which forms the logic circuit. Alternatively, the impurity concentration at the channel portion of the enhancement NMOS transistor which forms the driver may be set lower than that at the channel portion of the enhancement NMOS transistor which forms the logic circuit. This setting is also included in the third embodiment.

In the above embodiments, droplets discharged from the printhead are ink, and a liquid stored in the ink tank is ink. The content of the ink tank is not limited to ink. For example, the ink tank may contain a processing solution to be discharged onto a printing medium in order to increase the fixing properties, water resistance, or quality of a printed image.

The above embodiments can employ an element such as a piezoelectric element or heat generation element as an energy generation element for discharging ink. Of ink-jet printing systems, the embodiments can adopt a system which comprises a means (e.g., an electrothermal transducer) for generating heat energy as energy utilized to discharge ink and causes a state change of ink by the heat energy. This ink-jet printing system can increase the printing density and resolution.

As a representative arrangement or principle, the present invention preferably uses the basic principle disclosed in, e.g., U.S. Pat. No. 4,723,129 or 4,740,796. This system is applicable to both a so-called on-demand apparatus and continuous apparatus. The system is particularly effective in an on-demand apparatus because of the following reason. At least one driving signal which corresponds to printing information and gives a rapid temperature rise exceeding nuclear boiling is applied to an electrothermal transducer which corresponds to a sheet or liquid channel holding a liquid (ink). This signal causes the electrothermal transducer to generate heat energy and causes film boiling on the heat acting surface of a printhead. Consequently, a bubble can be formed in the liquid (ink) in one-to-one correspondence with the driving signal.

Growth/shrinkage of this bubble discharges the liquid (ink) from an orifice to form at least one droplet. This driving signal is more preferably a pulse signal because growth and shrinkage of a bubble are instantaneously appropriately performed. Discharge of the liquid (ink) with high response is achieved.

The above-described embodiments can employ an element such as a piezoelectric element or heat generation element as an energy generation element for discharging ink. Of ink-jet printing systems, the embodiments can adopt a system-which has a means (e.g., electrothermal transducer) for generating heat energy as energy utilized to discharge ink, and changes the ink state by the heat energy. This ink-jet printing system can realize high-density, high-precision printing.

The arrangement of the printhead can be a combination (linear liquid channel or right-angle liquid channel) of orifices, liquid channels, and electrothermal transducers disclosed in the specifications described above. The present invention also includes arrangements disclosed in U.S. Pat. Nos. 4,558,333 and 4,459,600 in each of which the heat acting surface is placed in a bent region. The present invention also uses an arrangement based on Japanese Patent Laid-Open No. 59-123670 in which a common slot is used as a discharge portion of a plurality of electrothermal transducers or Japanese Patent Laid-Open No. 59-138461 in which an opening for absorbing the pressure wave of heat energy is opposed to a discharge portion.

A full line type printhead having a length corresponding to the width of the largest printing medium printable by a printing apparatus can have a structure which meets this length by combining a plurality of printheads as disclosed in the above-mentioned specifications or can be a single integrated printhead.

It is possible to use not only a cartridge type printhead, explained in the above embodiments, in which ink tanks are integrated with a printhead itself, but also an interchangeable chip type printhead which can be electrically connected to an apparatus main body and supplied with ink from the apparatus main body when attached to the apparatus main body.

Adding a recovering means or preliminary means for a printhead to the arrangement of the printing apparatus described above is preferable because printing can further stabilize. Practical examples of the additional means for a printhead are a capping means, a cleaning means, a pressurizing or drawing means, and an electrothermal transducer or another heating element, or a preliminary heating means combining them. A predischarge mode for performing discharge different from printing is also effective to perform stable printing.

The printing mode of the printing apparatus is not restricted to a printing mode using only a main color such as black. The apparatus can have at least a composite color mode using different colors and a full color mode using mixed colors, regardless of whether a printhead is an integrated head or a combination of a plurality of heads.

The above embodiments are explained assuming that ink is a liquid. However, it is possible to use ink which solidifies at room temperature or less but softens or liquefies at room temperature. In inkjet systems, the general approach is to perform temperature control such that the viscosity of ink falls within a stable discharge range by adjusting the temperature of the ink itself within the range of 30° C. to 70° C. Hence, ink needs only to be a liquid when a printing signal used is applied to it.

To positively prevent a temperature rise caused by heat energy by positively using this temperature rise as energy of the state change from the solid state to the liquid state of ink, or to prevent evaporation of ink, ink which solidifies when left to stand and liquefies when heated can be used. The present invention is applicable to any ink which liquefies only when heat energy is applied, such as ink which liquefies when applied with heat energy corresponding to a printing signal and is discharged as liquid ink, or ink which already starts to solidify when arriving at a printing medium.

As described in Japanese Patent Laid-Open No. 54-56847 or 60-71260, this type of ink can be held as a liquid or solid in a recess or through hole in a porous sheet and opposed to an electrothermal transducer in this state. In the present invention, executing the aforementioned film boiling scheme is most effective for each ink described above.

Furthermore, the printing apparatus according to the present invention can take the form of any of an integrated or separate image output terminal of an information processing apparatus such as a computer, a copying apparatus combined with a reader or the like, and a facsimile apparatus having a transmission/reception function.

As has been described above, the threshold of a transistor on the driver side is higher than that of a transistor on the logic circuit side in the ink-jet printhead board, ink-jet printhead, and ink-jet printing apparatus according to the present invention. Even when a voltage supplied from the printing apparatus main body is 3.3 V or lower, a stable operation can be realized without any malfunction of the driver even under this voltage condition.

The drivability of the element can be improved. Even if the power supply voltage is changed from 5 V to 3.3 V, the printing apparatus can maintain a high data transfer rate and cope with high-speed printing.

As many apparently widely different embodiments of the present invention can be made without departing from the spirit and scope thereof, it is to be understood that the invention is not limited to the specific embodiments thereof except as defined in the claims.

What is claimed is:

1. An ink-jet printhead board comprising:

an energy generation element for generating energy used to discharge ink;

a driver circuit connected to the energy generation element to deliver a current for driving the energy generation element, the driver circuit comprising an enhancement NMOS transistor;

a shift register for receiving recording data;

a transmitting element for transmitting a signal to control the driver circuit to deliver the current to the energy generation element based on the recording data received by the shift register; and a logic circuit including at least the shift register and the transmitting element, configured to operate based on a logic signal voltage for operating the shift register, the logic circuit comprising an enhancement NMOS transistor, wherein a voltage threshold of the enhancement NMOS transistor of the logic circuit is lower than a voltage threshold of the enhancement NMOS transistor of the driver circuit, and wherein a drivability of the enhancement NMOS transistor of the logic circuit is higher than a drivability of the enhancement NMOS transistor of the driver circuit.

2. The board according to claim 1, wherein the logic circuit operates at a voltage of not more than 3.3V.

3. The board according to claim 1, wherein the energy generation element comprises an electrothermal transducer for generating heat energy necessary to discharge ink.

4. An ink-jet printhead board comprising:

an energy generation element for generating energy used to discharge ink;

a driver circuit connected to the energy generation element to deliver a current for driving the energy generation element, the driver circuit comprising an enhancement NMOS transistor;

a shift register for receiving recording data;

a transmitting element for transmitting a signal to control the driver circuit to deliver the current to the energy generation element based on the recording data received by the shift register; and a logic circuit including at least the shift register and the transmitting element, configured to operate based on a logic signal voltage for operating the shift register, the logic circuit comprising an enhancement NMOS transistor, wherein a gate oxide film thickness of the enhancement NMOS transistor of the driver circuit is thicker than a gate oxide film thickness of the enhancement NMOS transistor of the logic circuit, and wherein a drivability of the enhancement NMOS transistor of the logic circuit is higher than a drivability of the enhancement NMOS transistor of the driver circuit.

5. The board according to claim 4, wherein the logic circuit operates at a voltage of not more than 3.3V.

6. The board according to claim 4, wherein the energy generation element comprises an electrothermal transducer for generating heat energy necessary to discharge ink.

7. An ink-jet printhead board comprising:

an energy generation element for generating energy used to discharge ink;

a driver circuit connected to the energy generation element to deliver a current for driving the energy generation element, the driver circuit comprising an enhancement NMOS transistor;

a shift register for receiving recording data;

a transmitting element for transmitting a signal to control the driver circuit to deliver the current to the energy generation element based on the recording data received by the shift register; and a logic circuit including at least the shift register and the transmitting element, configured to operate based on a logic signal voltage for operating the shift register, the logic circuit comprising an enhancement NMOS transistor, wherein an impurity concentration at a channel portion of the enhancement NMOS transistor of the driver circuit is higher than an impurity concentration at a channel portion of the enhancement NMOS transistor of the logic circuit, and wherein a drivability of the enhancement NMOS transistor of the logic circuit is higher than a drivability of the enhancement NMOS transistor of the driver circuit.

8. The board according to claim 7, wherein the gate oxide film thickness of the enhancement NMOS transistor of the driver circuit is thicker than the gate oxide film thickness of the enhancement NMOS transistor of the logic circuit.

9. The board according to claim 7, wherein the logic circuit operates at a voltage of not more than 3.3V.

10. The board according to claim 7, wherein the energy generation element comprises an electrothermal transducer for generating heat energy necessary to discharge ink.

11. An ink-jet printhead comprising:

an ink orifice for discharging ink;

an energy generation element for generating energy used to discharge ink;

an ink channel communicating with the ink orifice, wherein the energy generation element is disposed at the ink channel;

a driver circuit connected to the energy generation element to deliver a current for driving the energy generation element, the driver circuit comprising an enhancement NMOS transistor;

a shift register for receiving recording data;

a transmitting element for transmitting a signal to control the driver circuit to deliver the current to the energy generation element based on the recording data received by the shift register; and a logic circuit including at least the shift register and the transmitting element, configured to operate based on a logic signal voltage for operating the shift register, the logic circuit comprising an enhancement NMOS transistor, wherein a voltage threshold of the enhancement NMOS transistor of the logic circuit is lower than a voltage threshold of the enhancement NMOS transistor of the driver circuit, and wherein a drivability of the enhancement NMOS transistor of the logic circuit is higher than a drivability of the enhancement NMOS transistor of the driver circuit.

12. The printhead according to claim 11, wherein the logic circuit operates at a voltage of not more than 3.3V.

13. The printhead according to claim 11, wherein the energy generation element comprises an electrothermal transducer for generating heat energy necessary to discharge ink.

14. The printhead according to claim 11, wherein said printhead is integrally connected to an ink tank, and said printhead and tank together serve as an exchangeable ink cartridge.

15. An ink-jet printhead comprising:

an ink orifice for discharging ink;

an energy generation element for generating energy used to discharge ink;

an ink channel communicating with the ink orifice, wherein the energy generation element is disposed at the ink channel;

a driver circuit connected to the energy generation element to deliver a current for driving the energy generation element, the driver circuit comprising an enhancement NMOS transistor;

a shift register for receiving recording data;

a transmitting element for transmitting a signal to control the driver circuit to deliver the current to the energy generation element based on the recording data received by the shift register; and a logic circuit including at least the shift register and the transmitting element, configured to operate based on a logic signal voltage for operating the shift register, the logic circuit comprising an enhancement NMOS transistor, wherein a gate oxide film thickness of the enhancement NMOS transistor of the driver circuit is thicker than a gate oxide film thickness of the enhancement NMOS transistor of the logic circuit, and wherein a drivability of the enhancement NMOS transistor of the logic circuit is higher than a drivability of the enhancement NMOS transistor of the driver circuit.

16. The printhead according to claim 15, wherein the logic circuit operates at a voltage of not more than 3.3V.

17. The printhead according to claim 15, wherein the energy generation element comprises an electrothermal transducer for generating heat energy necessary to discharge ink.

18. The printhead according to claim 15, wherein said printhead constitutes an exchangeable ink cartridge by integration into one body with an ink tank which stores the ink.

19. An ink-jet printhead comprising:

an ink orifice for discharging ink;

an energy generation element for generating energy used to discharge ink;

an ink channel communicating with the ink orifice, wherein the energy generation element is disposed at the ink channel;

a driver circuit connected to the energy generation element to deliver a current for driving the energy generation element, the driver circuit comprising an enhancement NMOS transistor;

a shift register for receiving recording data;

a transmitting element for transmitting a signal to control the driver circuit to deliver the current to the energy generation element based on the recording data received by the shift register; and a logic circuit including at least the shift register and the transmitting element, configured to operate based on a logic signal voltage for operating the shift register, the logic circuit comprising an enhancement NMOS transistor, wherein an impurity concentration at a channel portion of the enhancement NMOS transistor of the driver circuit is higher than an impurity concentration at a channel portion of the enhancement NMOS transistor of the logic circuit, and wherein a drivability of the enhancement NMOS transistor of the logic circuit is higher than a drivability of the enhancement NMOS transistor of the driver circuit.

20. The printhead according to claim 19, wherein the gate oxide film thickness of the enhancement NMOS transistor of the driver circuit is thicker than the gate oxide film thickness of the enhancement NMOS transistor of the logic circuit.

21. The printhead according to claim 19, wherein the logic circuit operates at a voltage of not more than 3.3V.

22. The printhead according to claim 19, wherein the energy generation element comprises an electrothermal transducer for generating heat energy necessary to discharge ink.

23. The printhead according to claim 19, wherein said printhead is integrally connected to an ink tank, and said printhead and tank together serve as an exchangeable ink cartridge.

24. An ink-jet recording apparatus comprising:

an ink-jet printhead having an ink orifice for discharging ink, an energy generation element for generating energy used to discharge ink, an ink channel communicating with the ink orifice, wherein the energy generation element is disposed at the ink channel, a driver circuit connected to the energy generation element to deliver a current for driving the energy generation element, the driver circuit comprising an enhancement NMOS transistor, a shift register for receiving recording data, a transmitting element for transmitting a signal to control the driver circuit to deliver the current to the energy generation element based on the recording data received by the shift register; and means for transmitting the recording data to the ink-jet printhead;

a logic circuit including at least the shift register and the transmitting element, configured to operate based on a logic signal voltage for operating the shift register, the logic circuit comprising an enhancement NMOS transistor, wherein a voltage threshold of the enhancement NMOS transistor of the logic circuit is lower than a voltage threshold of the enhancement NMOS transistor of the driver circuit, and wherein a drivability of the enhancement NMOS transistor of the logic circuit is higher than a drivability of the enhancement NMOS transistor of the driver circuit.

25. The recording apparatus according to claim 24, wherein the logic circuit operates at a voltage of not more than 3.3V.

26. An ink jet recording apparatus comprising:

an ink-jet printhead having an ink orifice for discharging ink, an energy generation element for generating energy used to discharge ink, an ink channel communicating with the ink orifice, wherein the energy generation element is disposed at the ink channel, a driver circuit connected to the energy generation element to deliver a current for driving the energy generation element, the driver circuit comprising an enhancement NMOS transistor, a shift register for receiving recording data, a transmitting element for transmitting a signal to control the driver circuit to deliver the current to the energy generation element based on the recording data received by the shift register; and means for transmitting the recording data to the ink-jet printhead;

a logic circuit including at least the shift register and the transmitting element, configured to operate based on a logic signal voltage for operating the shift register, the logic circuit comprising an enhancement NMOS transistor, wherein a gate oxide film thickness of the enhancement NMOS transistor of the driver circuit is thicker than a gate oxide film thickness of the enhancement NMOS transistor of the logic circuit, and wherein a drivability of the enhancement NMOS transistor of the logic circuit is higher than a drivability of the enhancement NMOS transistor of the driver circuit.

27. The recording apparatus according to claim 26, wherein the logic circuit operates at a voltage of not more than 3.3V.

28. The recording apparatus according to claim 26, wherein the energy generation element comprises an electrothermal transducer for generating heat energy necessary to discharge ink.

29. An ink-jet recording apparatus comprising:

an ink-jet printhead having an ink orifice for discharging ink, an energy generation element for generating energy used to discharge ink, an ink channel communicating with the ink orifice, wherein the energy generation element is disposed at the ink channel, a driver circuit connected to the energy generation element to deliver a current for driving the energy generation element, the driver circuit comprising an enhancement NMOS transistor, a shift register for receiving recording data, a transmitting element for transmitting a signal to control the driver circuit to deliver the current to the energy generation element based on the recording data received by the shift register; and means for transmitting the recording data to the ink-jet printhead;

a logic circuit including at least the shift register and the transmitting element, configured to operate based on a logic signal voltage for operating the shift register, the logic circuit comprising an enhancement NMOS transistor, wherein an impurity concentration at a channel portion of the enhancement NMOS transistor of the driver circuit is higher than an impurity concentration at a channel portion of the enhancement NMOS transistor of the logic circuit, and wherein a drivability of the enhancement NMOS transistor of the logic circuit is higher than a drivability of the enhancement NMOS transistor of the driver circuit.

30. The recording apparatus according to claim 29, wherein the gate oxide film thickness of the enhancement NMOS transistor of the driver circuit is thicker than the gate oxide film thickness of the enhancement NMOS transistor of the logic circuit.

31. The recording apparatus according to claim 29, wherein the logic circuit operates at a voltage of not more than 3.3V.

32. The recording apparatus according to claim 29, wherein the energy generation element comprises an electrothermal transducer for generating heat energy necessary to discharge ink.

* * * * *